US006006376A

United States Patent [19]

Williamson

[11] Patent Number: 6,006,376

[45] Date of Patent: Dec. 28, 1999

[54] PATIENT LIFTING AND TRANSPORT APPARATUS AND METHOD

[76] Inventor: Ted Williamson, 648 Ideal Wy., Charlotte, N.C. 28203

[21] Appl. No.: 09/054,728

[22] Filed: Apr. 3, 1998

[51] Int. Cl.[6] ..... A61G 7/10

[52] U.S. Cl. ..... 5/81.1 R; 5/83.1; 5/85.1; 5/86.1

[58] Field of Search ..... 5/600, 81.1 R, 5/83.1, 85.1, 86.1, 89.1; 294/67.3, 67.33, 74, 77

[56] References Cited

U.S. PATENT DOCUMENTS

| | | |
|---|---|---|
| 528,475 | 10/1894 | Goulding . |
| 545,741 | 9/1895 | Shutters . |
| 680,814 | 8/1901 | Smith . |
| 775,520 | 11/1904 | Grigler . |
| 904,587 | 11/1908 | Wible . |
| 1,227,301 | 5/1917 | Ogden . |
| 1,263,611 | 4/1918 | Scroggin . |
| 1,301,284 | 4/1919 | Ledan . |
| 1,451,437 | 4/1923 | Bernier . |
| 1,588,573 | 6/1926 | Edmiston . |
| 1,968,477 | 7/1934 | Cole . |
| 2,035,116 | 3/1936 | Elmick . |
| 2,100,663 | 11/1937 | Maddox . |
| 2,283,511 | 5/1942 | Sellers et al. . |
| 2,603,851 | 7/1952 | Hawkins . |
| 2,629,108 | 2/1953 | Wickey . |
| 3,334,360 | 8/1967 | Hoxeng et al. . |
| 3,373,451 | 3/1968 | Schmidt . |
| 3,383,717 | 5/1968 | Underwood . |
| 3,701,170 | 10/1972 | Bond . |
| 5,068,931 | 12/1991 | Smith . |
| 5,235,712 | 8/1993 | Smith . |
| 5,570,483 | 11/1996 | Williamson . |

FOREIGN PATENT DOCUMENTS

| | | |
|---|---|---|
| 4795 | 2/1914 | United Kingdom . |
| 850516 | 10/1960 | United Kingdom . |

*Primary Examiner*—Michael F. Trettel
*Assistant Examiner*—Fredrick Conley
*Attorney, Agent, or Firm*—Adams Law Firm, P.A.

[57] ABSTRACT

A convertible patient lifting and transport apparatus includes a frame assembly mounted on wheels and adapted for rolling movement over a supporting surface. The frame assembly defines a patient carriage zone for being occupied by a patient above the supporting surface. A patient support is carried by the frame assembly. The patient support is convertible for supporting the patient in the carriage zone in a generally supine position and in a seated position. A mechanical elevating assembly is provided for lifting and lowering the patient support relative to the frame assembly. A frame conversion assembly moves the frame assembly between an open condition wherein the frame assembly expands for straddling a bed of the patient when lifting and removing the patient from the bed, and a closed condition wherein the frame assembly retracts outside of an area surrounding the bed for transporting the patient to a location away from the bed.

36 Claims, 29 Drawing Sheets

PATIENT LIFTING AND TRANSPORT APPARATUS AND METHOD

TECHNICAL FIELD AND BACKGROUND OF THE INVENTION

This invention relates to a convertible patient lifting and transport apparatus, and to a method of transporting a patient from the bed to the toilet, or other distant location, and then back to the bed. The invention is especially applicable for use in the health care industry to reduce the incidence of on-the-job injury associated with manually lifting, handling and transferring patients. Injuries to the back and shoulder are most common.

Standard programs for health care injury prevention focus on body mechanics and back care, and the proper lifting techniques to employ when handling a patient. Notwithstanding this, injuries result even when proper body mechanics and lifting techniques are used. Lifting a patient is not simply overcoming a heavy weight. The patient's physical condition, size, shape, deformities, physical impairments, and weight are all factors impacting the manner in which a transfer is made. Some patients are combative and uncooperative. Patients can also be unpredictable, suddenly resisting movement and throwing caregivers off balance during a lift or transfer. Optimum posture is often difficult to maintain making the proper lifting technique impractical to follow.

Although mechanical and electromechanical lifting devices have been available for years, statistics showing physical overexertion from lifting and transferring bedridden patients remain unacceptable. Some nurses and other caregivers are reluctant to use such devices because of their many drawbacks and limitations. Among the disadvantages are the excessive time required to perform the lift and the instability of the patient in the device during the lift. Such devices can also aggravate sensitive skin, and typically place the patient in an embarrassing position when lifted. Moreover, these devices create storage problems, are difficult to maneuver, and generally cannot move sufficiently close to the patient's bed to effect a safe and proper transfer.

Many of the above problems were first addressed by the applicant in its prior issued patent, U.S. Pat. No. 5,570,483. The complete disclosure of this patent is incorporated herein by reference.

The present invention has features and advantages beyond those described in the '483 Patent. The invention includes a convertible support frame which expands to straddle the bed of the patient, and retracts to facilitate maneuvering within the patient's room. The patient is transferred between the bed and the bathroom and moved from a generally supine position to a seated position without any manual lifting or handling.

SUMMARY OF THE INVENTION

Therefore, it is an object of the invention to provide a patient lifting and transport apparatus which allows transfer of a patient from the bed to the bathroom without any manual lifting or handling.

It is another object of the invention to provide a patient lifting and handling apparatus which converts between an open expanded condition and a closed retracted condition.

It is another object of the invention to provide a patient lifting and transport apparatus capable of moving the patient between a generally supine position and a seated position.

It is another object of the invention to provide a patient lifting and transport apparatus which allows the patient to use the toilet without leaving the apparatus.

It is another object of the invention to provide a patient lifting and transport apparatus which can be conveniently operated by a single caregiver.

It is another object of the invention to provide a patient lifting and transport apparatus which will substantially reduce the incidence of on-the-job injury in the health care industry.

It is another object of the invention to provide a patient lifting and transport apparatus which is completely self-contained.

It is another object of the invention to provide a patient lifting and transport apparatus which can be moved directly over the bed of the patient.

It is another object of the invention to provide a patient lifting and transport apparatus which can be moved directly over a toilet.

It is another object of the invention to provide a method of transferring a patient between the bed and a location away from the bed without requiring manual lifting or handling.

These and other objects of the present invention are achieved in the preferred embodiments disclosed below by providing a convertible patient lifting and transport apparatus. The apparatus includes a frame assembly mounted on wheels and adapted for rolling movement over a supporting surface. The frame assembly defines a patient carriage zone for being occupied by a patient above the supporting surface. Patient support means are carried by the frame assembly for supporting the patient in the carriage zone. Mechanical elevating means are provided for lifting and lowering the patient support means relative to the frame assembly. Frame assembly conversion means move the frame assembly between an open condition wherein the frame assembly expands for straddling a bed of the patient to lift and remove the patient from the bed on the support means, and a closed condition wherein the frame assembly retracts for transporting the patient to a location away from the bed.

According to one preferred embodiment of the invention, the frame assembly includes spaced-apart upstanding front and rear end frames. A top frame is arranged above the patient carriage zone and interconnects the front and rear end frames together.

According to another preferred embodiment of the invention, the front and rear end frames include respective pairs of spaced-apart vertical support members and telescoping lateral cross braces interconnecting the vertical support members of each pair together.

According to yet another preferred embodiment of the invention, the top frame includes first and second spaced-apart, telescoping longitudinal support members connected at their respective opposite ends to the pairs of spaced-apart vertical support members. Telescoping lateral cross braces interconnect the longitudinal support members together.

According to yet another preferred embodiment of the invention, the patient support means includes a fabric hammock. A plurality of cables extend downwardly from the top frame for suspending the hammock in the patient carriage zone.

According to yet another preferred embodiment of the invention, the hammock includes first and second longitudinal side bars attached at opposite side edges of the hammock.

According to yet another preferred embodiment of the invention, each of the supports bars includes a back hinge for allowing upward pivoting movement of a back portion of the hammock to lift the patient from a generally supine position to a seated position.

According to yet another preferred embodiment of the invention, each of the side bars further includes a front hinge for allowing downward pivoting movement of a front portion of the hammock such that the legs of the patient can bend when in the seated position.

According to yet another preferred embodiment of the invention, the front hinge includes ratchet means for adjustably setting the angle of the front portion of the hammock relative to the back portion of the hammock.

According to yet another preferred embodiment of the invention, a safety belt is attached to the hammock and is adapted for extending around the waist of the patient to secure the patient in the hammock.

According to yet another preferred embodiment of the invention, the hammock includes an opening formed in a seat portion thereof for allowing use a toilet by the patient without leaving the apparatus.

According to yet another preferred embodiment of the invention, a disposable sanitary liner is placed at the opening of the hammock, and includes a cylindrical chute adapted for extending downwardly into the toilet upon use of the toilet by the patient.

According to yet another preferred embodiment of the invention, a flap is attached to an underside of the hammock for covering the opening in the hammock before and after use of the toilet by the patient.

According to yet another preferred embodiment of the invention, a lateral spreader bar is attached to opposite side edges of the hammock. The spreader bar is located between the hammock and the cables for maintaining the hammock in a laterally spread condition as the patient is lifted and lowered.

According to yet another preferred embodiment of the invention, the mechanical elevating means includes a motor assembly arranged on the top frame and operatively connected to the plurality of cables for lifting and lowering the cables to adjust the hammock between a horizontal condition and an upwardly folded condition.

According to yet another preferred embodiment of the invention, the frame assembly conversion means includes first and second linear actuators attached to the frame assembly for moving the frame assembly between the open and closed conditions.

A method of transporting a patient according to one preferred embodiment of the invention includes the steps of providing a transport apparatus including a convertible frame assembly mounted on wheels for rolling movement over a supporting surface. The frame assembly is movable between an open condition and a closed condition. The frame assembly is moved in the open condition to a location straddling the bed of the patient. The patient is then positioned on support means carried by the frame assembly. The support means supports the patient in a carriage zone defined by the frame assembly. The frame assembly is then moved away from its position straddling the bed with the patient located in the carriage zone. The frame assembly is then converted from the open condition to the closed condition to reduce its widthwise and lengthwise dimension.

The patient is then transported to the location away from the bed. Upon return of the patient to the bed, the frame assembly is converted back to the open condition to increase its widthwise and lengthwise dimension, such that the frame assembly is moveable back to the location straddling the bed to unload the patient onto the bed.

According to another preferred embodiment of the invention, the method includes the step of adjusting the support means from a generally horizontal condition to an upwardly folded condition after positioning the patient onto the support means and prior to converting the frame assembly from the open condition to the closed condition.

In another embodiment, a convertible patient lifting and transport apparatus includes a frame assembly mounted on wheels and adapted for rolling movement over a supporting surface. The frame assembly defines a patient carriage zone for being occupied by a patient above the supporting surface. Patient support means are carried by the frame assembly for supporting the patient in the carriage zone. Patient support conversion means move the patient support means between a generally horizontal condition wherein the patient lies supine in the carriage zone, and an upwardly folded condition wherein the patient sits generally upright in the carriage zone.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
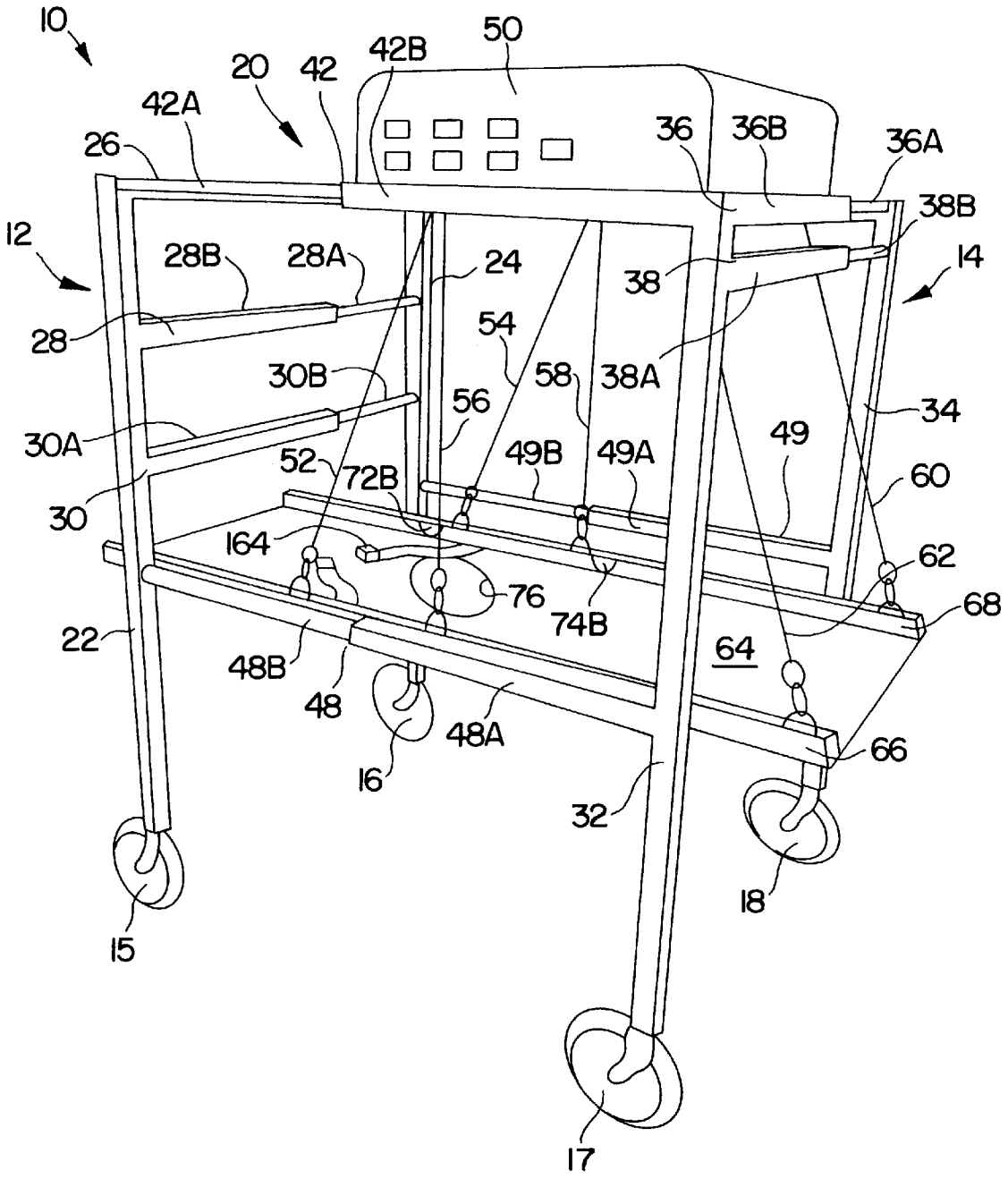
FIG. 1 is a front end perspective view of the patient lifting and transport apparatus according to one preferred embodiment of the invention.

Referring now specifically to the drawings, a patient lifting and transport apparatus according to the present invention is illustrated in FIG. 1 and shown generally at reference numeral 10. The apparatus 10 is particularly applicable for lifting and transporting a patient from a bed to the toilet without physical strain or risk of injury to the caregiver.

Figure 2:
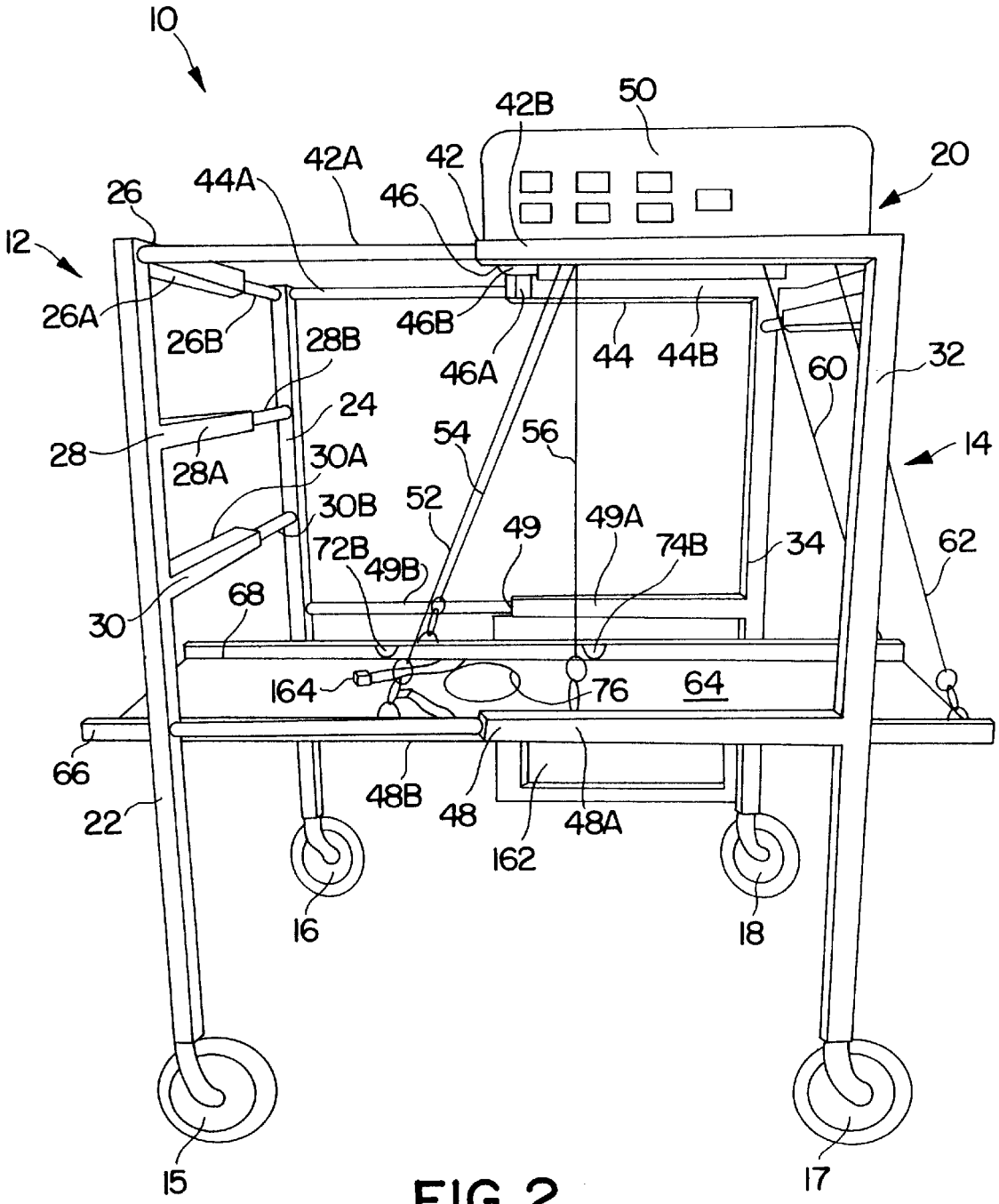
FIG. 2 is a side perspective view of the patient lifting and transport apparatus.

As shown in FIGS. 1 and 2, the apparatus 10 includes spaced-apart upstanding front and rear end frames 12 and 14 mounted on wheels 15, 16, 17, and 18, and a top frame 20 connected to the front and rear end frames 12, 14. The front end frame 12 includes vertical support members 22 and 24 and telescoping lateral cross braces 26 and 28 connecting the vertical support members 22, 24 together. Each cross brace 26, 28 has a slide rod 26A, 28A adapted for telescoping sliding movement within a larger hollow guide rod 26B, 28B. The guide rod 26B, 28B preferably includes an internal bearing (not shown) to facilitate axial movement of the slide rod 26A, 28A.

A linear actuator 30 is connected to the vertical support members 22, 24 below the cross brace 28 and includes a DC electric motor (not shown), a hollow screw shaft 30A, and a drive shaft 30B adapted for linear movement into and out of the screw shaft 30A. The DC motor actuates a worm gear which transmits power to an acme screw contained in the screw shaft 30A. Rotation of the screw actuates the drive shaft 30B. According to one embodiment, the actuator 30 is manufactured by SKF of Bethlehem, Pa. and sold under the trademark CATR 33.

The rear end frame 14 includes spaced-apart vertical support members 32 and 34 and a telescoping lateral cross brace 36 connecting the vertical support members 32, 34 together. The lateral cross brace 36 has a slide rod 36A adapted for telescoping sliding movement within a larger hollow guide rod 36B. A linear actuator 38, as described above, is connected to the vertical support members 32, 34 and includes a DC electric motor (not shown), a hollow screw shaft 38A, and a drive shaft 38B adapted for linear movement into and out of the screw shaft 38A. The cross brace 36 and linear actuator 38 are located at the top of the rear end frame 14 to define an opening sufficient for moving the apparatus 10 directly over the bed of the patient.

The top frame 20 includes spaced-apart, telescoping longitudinal support members 42 and 44 connected at their respective opposite ends to the vertical support members 22, 24 and 32, 34 of the front and rear end frames 12, 14, and a telescoping lateral cross brace 46. Each of the longitudinal support members 42, 44 and lateral cross brace 46 has a slide rod 42A, 44A, and 46A adapted for telescoping sliding movement within a larger hollow guide rod 42B, 44B, and 46B. A second pair of linear actuators 48 and 49 are connected at respective opposite ends to the vertical support members 22, 24 and 32, 34 of the front and rear end frames 12, 14 below the longitudinal support members 42, 44. Each linear actuator 48, 49 includes a DC electric motor (not shown), a hollow screw shaft 48A, 49A, and a drive shaft 48B, 49B adapted for linear movement into and out of the screw shaft 48A, 49A.

Figure 3:
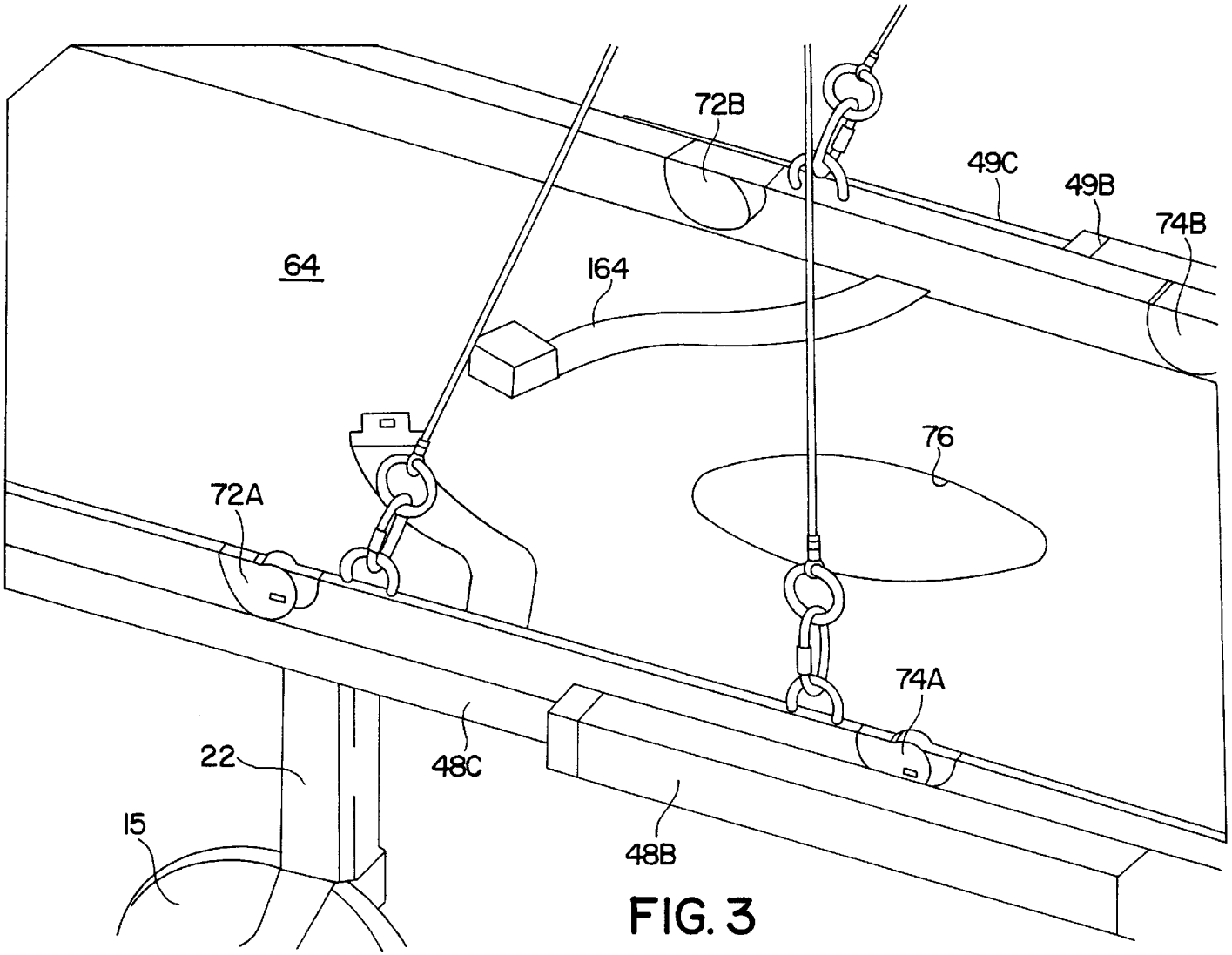
FIG. 3 is an enlarged, fragmentary perspective view of the hammock.
Figure 4:
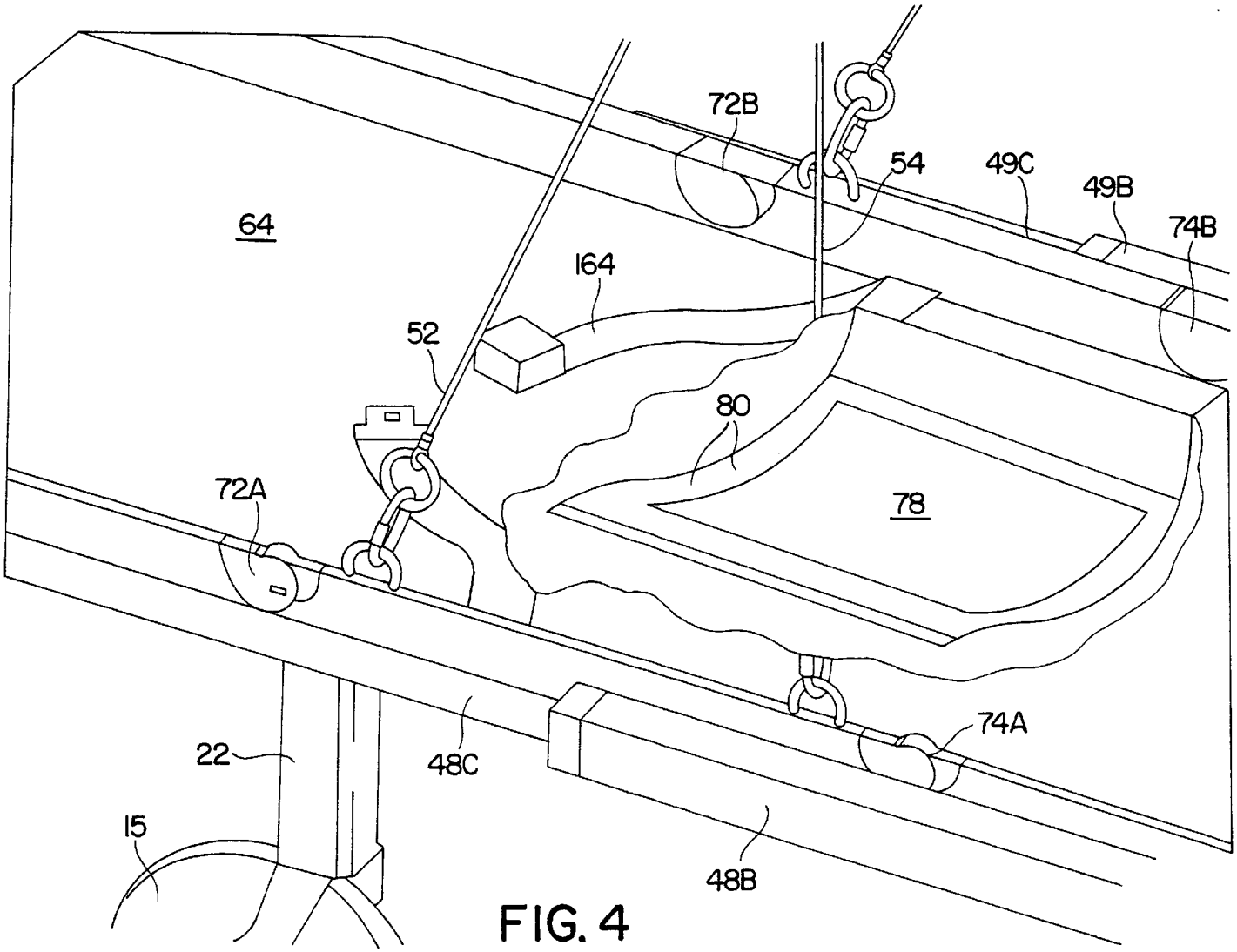
FIG. 4 is an enlarged, fragmentary perspective view of the hammock with the seat portion torn away to show the releasible flap for covering the oval opening.
Figure 5:
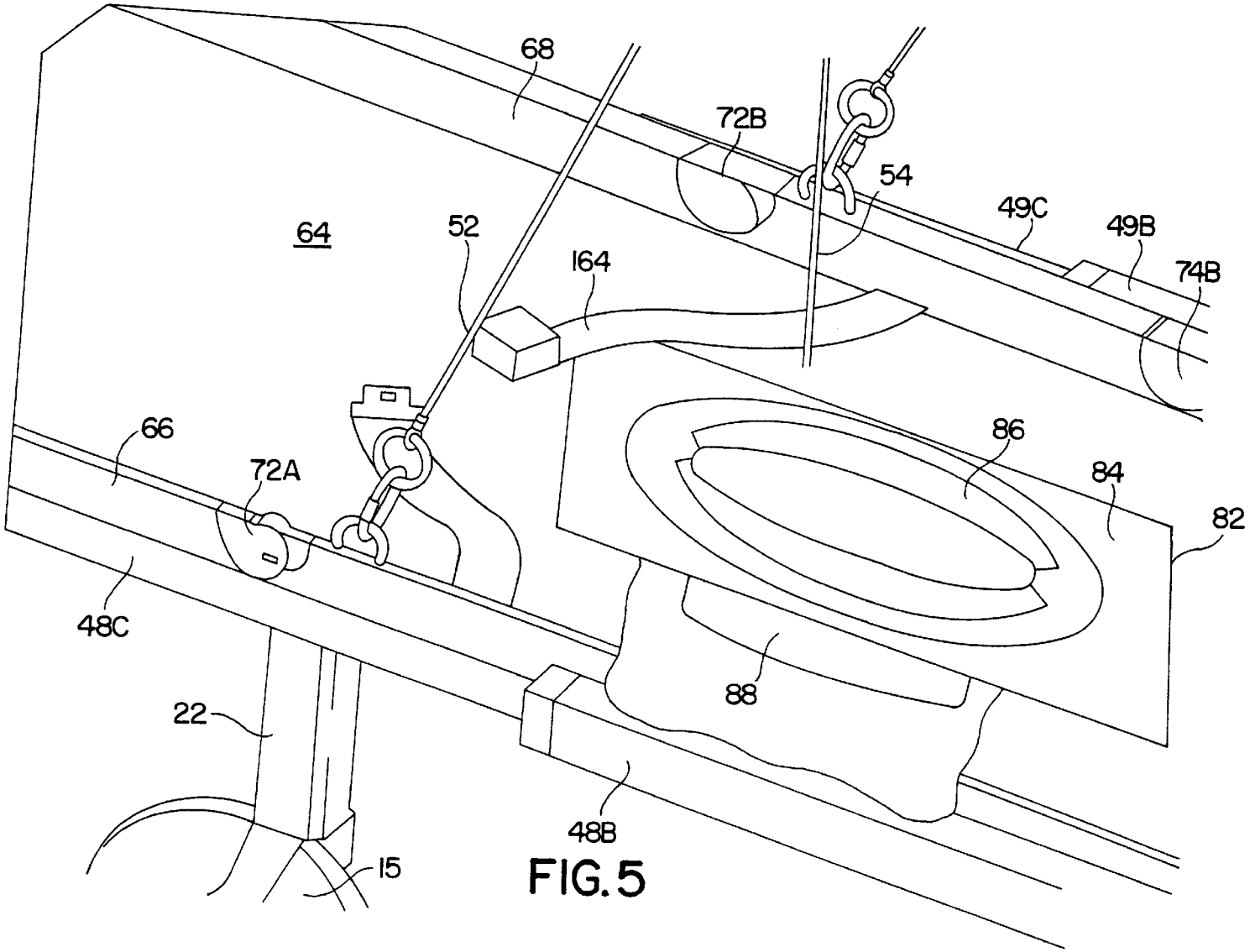
FIG. 5 is an enlarged, fragmentary perspective view of the hammock with the seat portion torn away and showing the sanitary liner positioned over the oval opening.
Figure 7:
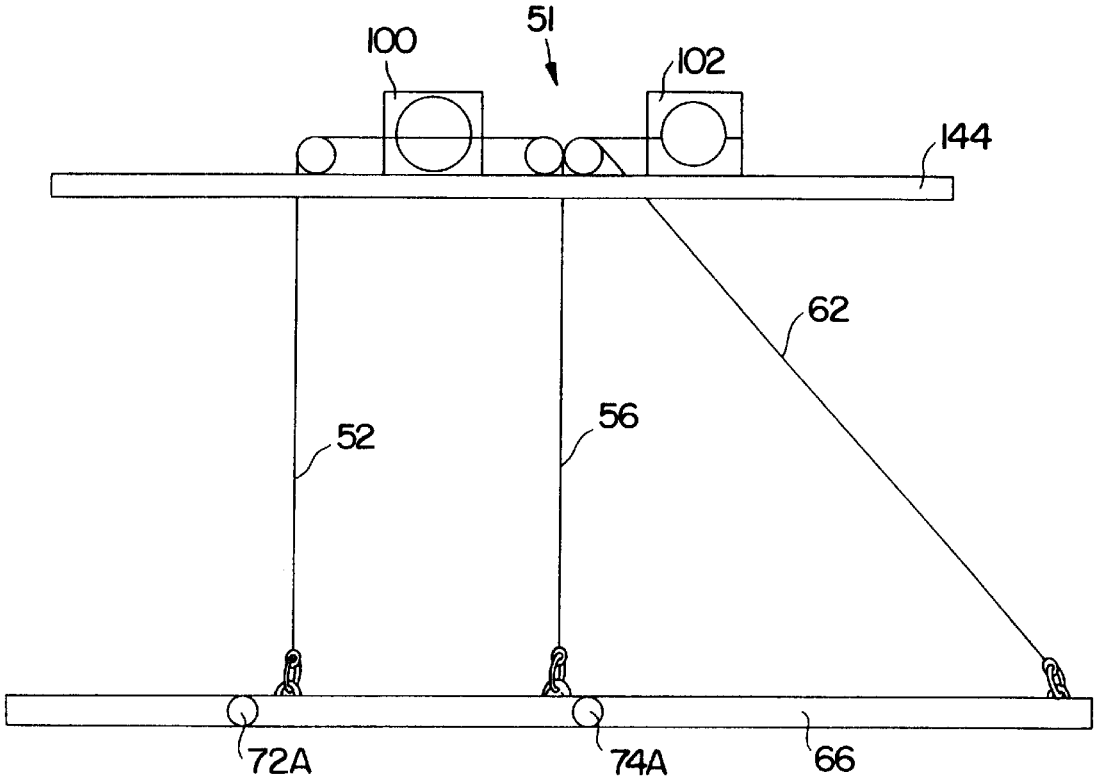
FIG. 7 is an elevational view of the motor assembly with the top of the motor housing removed and showing attachment of the cables to the hammock.
Figure 8:
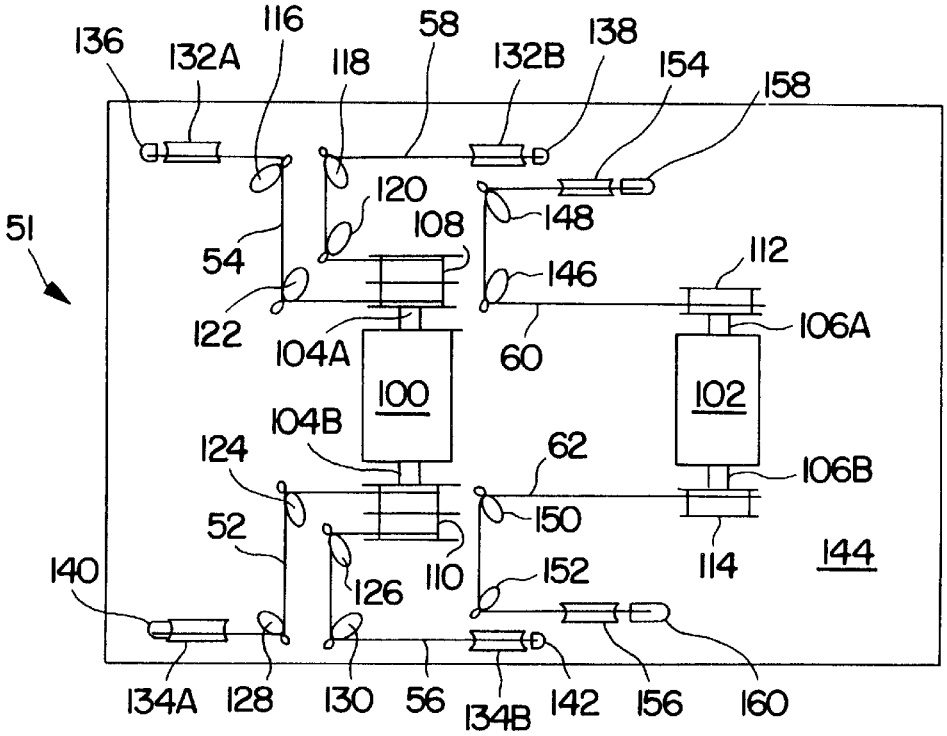
FIG. 8 is a top plan view of the motor assembly with the top of the motor housing removed.

The longitudinal support member 42 and cross braces 46 and 36 cooperate to support an overhead motor housing 50 enclosing a motor assembly 51 (See FIGS. 7 and 8). A number of cables 52, 54, 56, 58, 60, and 62 extend downwardly from the motor housing 50 and are removably attached to a flexible fabric hammock 64 adapted for carrying the patient. As best shown in FIGS. 3–5, the hammock 64 includes opposing, generally flat longitudinal side bars 66 and 68 with respective pairs of front and back flat hinges 72A, 72B and 74A, 74B for converting the hammock 64 from a generally horizontal support to a seat. The front hinges 72A, 72B are preferably ratcheted to allow angle adjustment of the foot end of the hammock 64 relative to a seat portion of the hammock 64. The back hinges 74A, 74B allow the hammock 64 to pivot freely between a generally horizontal condition and an upwardly folded condition.

An oval opening 76 is formed in the seat portion of the hammock 64 for allowing the patient to use the toilet without leaving the apparatus 10. Preferably, a fabric flap 78 is attached to the underside of the hammock 64 and includes a perimeter area of loop material 80 adapted for releasibly mating with complementary hooks (not shown) attached to the underside of the hammock 64 to cover the opening 76. As shown in FIG. 5, a disposable sanitary liner 82 is preferably laid over the oval opening 76 prior to positioning the patient on the hammock 64. The liner 82 includes a paper sheet 84 with a central opening 86 and attached biodegradable plastic chute 88 which dissolves in water. Upon transfer of the patient to the toilet, the fabric flap 78 is released and the chute 88 extended through the oval opening 76. The chute 88 is preferably perforated for convenient detachment from the paper sheet 84 and disposal after use.

Figure 6A:
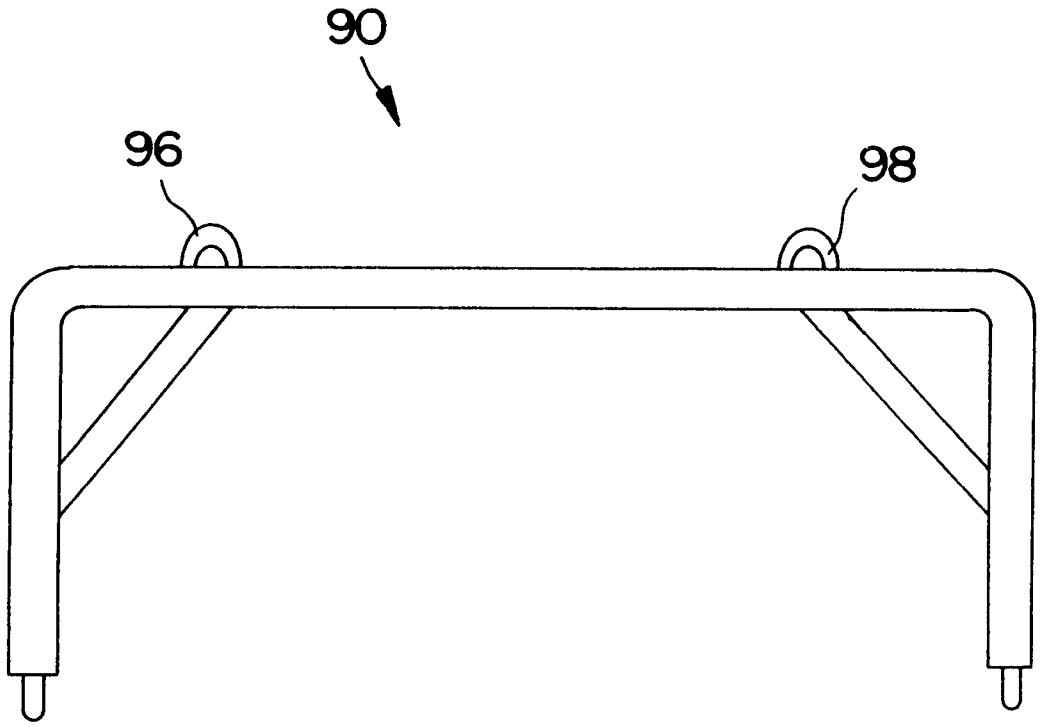
FIG. 6A is an elevational view of the spreader bar adapted for use at the foot end and head end of the hammock for preventing the hammock from sagging inwardly under the weight of the patient when lifted.
Figure 6B:
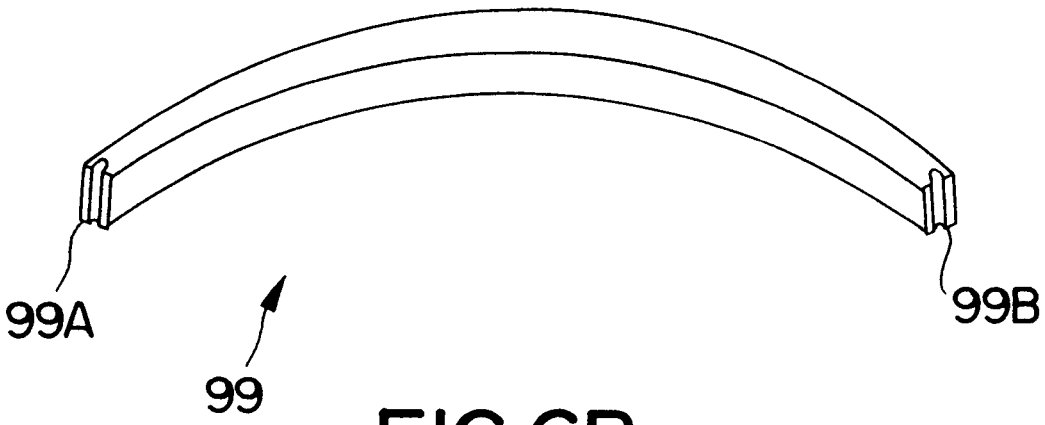
FIG. 6B is a perspective view of a second spreader bar adapted for use adjacent a back side of the hammock for supporting the back of the patient when in a seated position.

Referring again to FIGS. 1 and 2, seat support cables 52, 54, 56, and 58 are attached to the hinged side bars 66 and 68 adjacent the seat portion of the hammock 64. Back support cables 60 and 62 are attached to the side bars 66 and 68 adjacent the head end of the hammock 64 and are adapted for supporting the upper torso of the patient. The cables 52, 54, 56, 58, 60, and 62 cooperate to carry the patient in the hammock 64 in a patient carriage zone, and are manipulated by the motor assembly 51 to lift and lower the patient and to move the patient from a generally supine position to a seated position, as described further below. Spreader bars 90, such as shown in FIG. 6A, may be used at the foot end and head end of the hammock 64 to prevent the hammock 64 from sagging inwardly as the patient is lifted and transported. The ends 92 and 94 of each spreader bar 90 are attached to the side bars 66 and 68 of the hammock 64. The cables are attached at points 96 and 98. An arcuate spreader bar 99, as shown in FIG. 6B, may be used adjacent a back side of the hammock 64 for supporting the back of the patient when in a seated position. Notches 99A and 99B are preferably formed at opposite ends of the spreader bar 99 for engaging fabric handles (not shown) attached to respective side edges of the hammock 64. When not in use, the spreader bars 90 and 99 are conveniently secured to the top frame 20 for storage.

As shown in FIGS. 7 and 8, the motor assembly 51 includes a pair of DC electric motors 100 and 102 each having opposed rotating drive shafts 104A, 104B and 106A, 106B adapted for simultaneously winding and unwinding the support cables 52, 54, 56, 58, 60, and 62 onto and from respective take-up rolls 108, 110, 112, and 114. The seat support cables 52, 54, 56, and 58 are attached to take-up rolls 108 and 110 and extend through a series of guide pulleys 116, 118, 120, 122, 124, 126, 128, and 130 and over stationary pulleys 132A, 132B, 134A, and 134B outwardly through openings 136, 138, 140, and 142 formed in the bottom wall 144 of the motor housing 50 to the hammock 64. The back support cables 60 and 62 are attached to take-up rolls 112 and 114 and extend through guide pulleys 146, 148, 150, and 152 and over stationary pulleys 154 and 156 outwardly through openings 158 and 160. Simultaneous rotation of all of the take-up rolls 108, 110, 112, and 114 operates to lift and lower the hammock 64. Rotation of only take-up rolls 112 and 114 lifts the head end of the hammock 64 allowing the patient to sit in a generally upright position.

Figure 9:
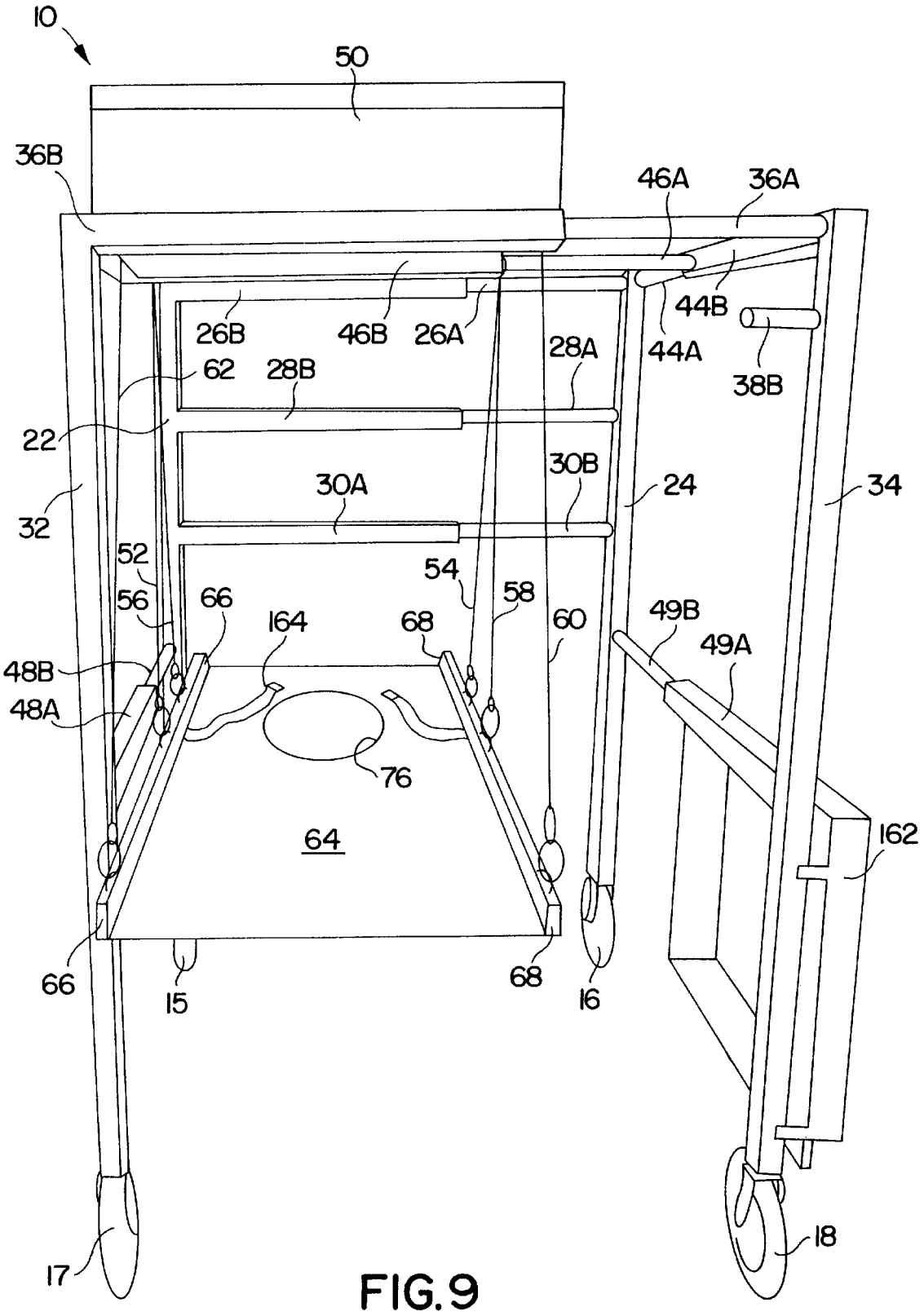
FIG. 9 is a front end perspective view of the apparatus with the actuator removed for clarity, and showing the apparatus expanded in a widthwise dimension.
Figure 10:
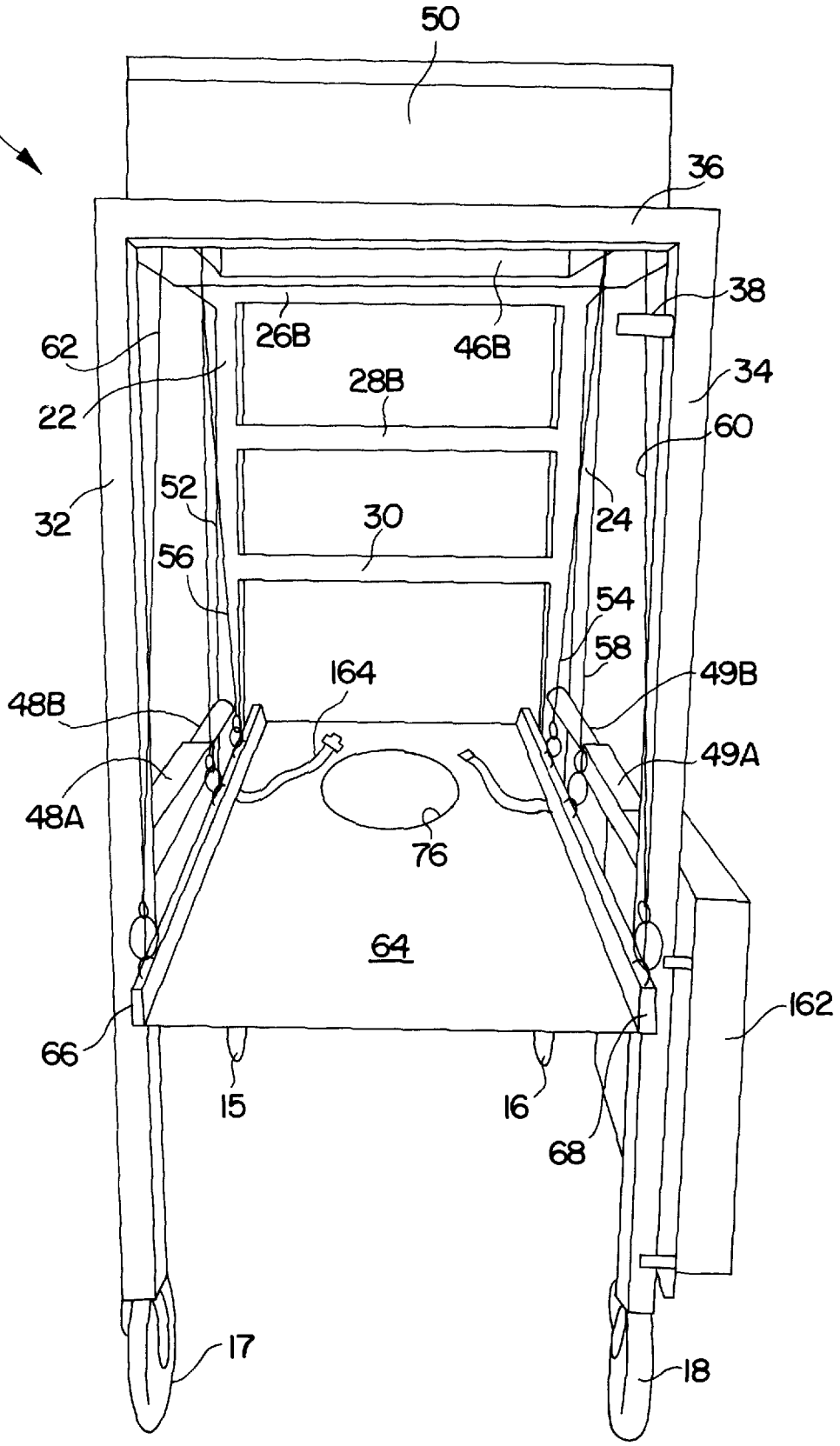
FIG. 10 is a front end perspective view of the apparatus with the actuator removed for clarity, and showing the apparatus retracted in the widthwise dimension.
Figure 11:
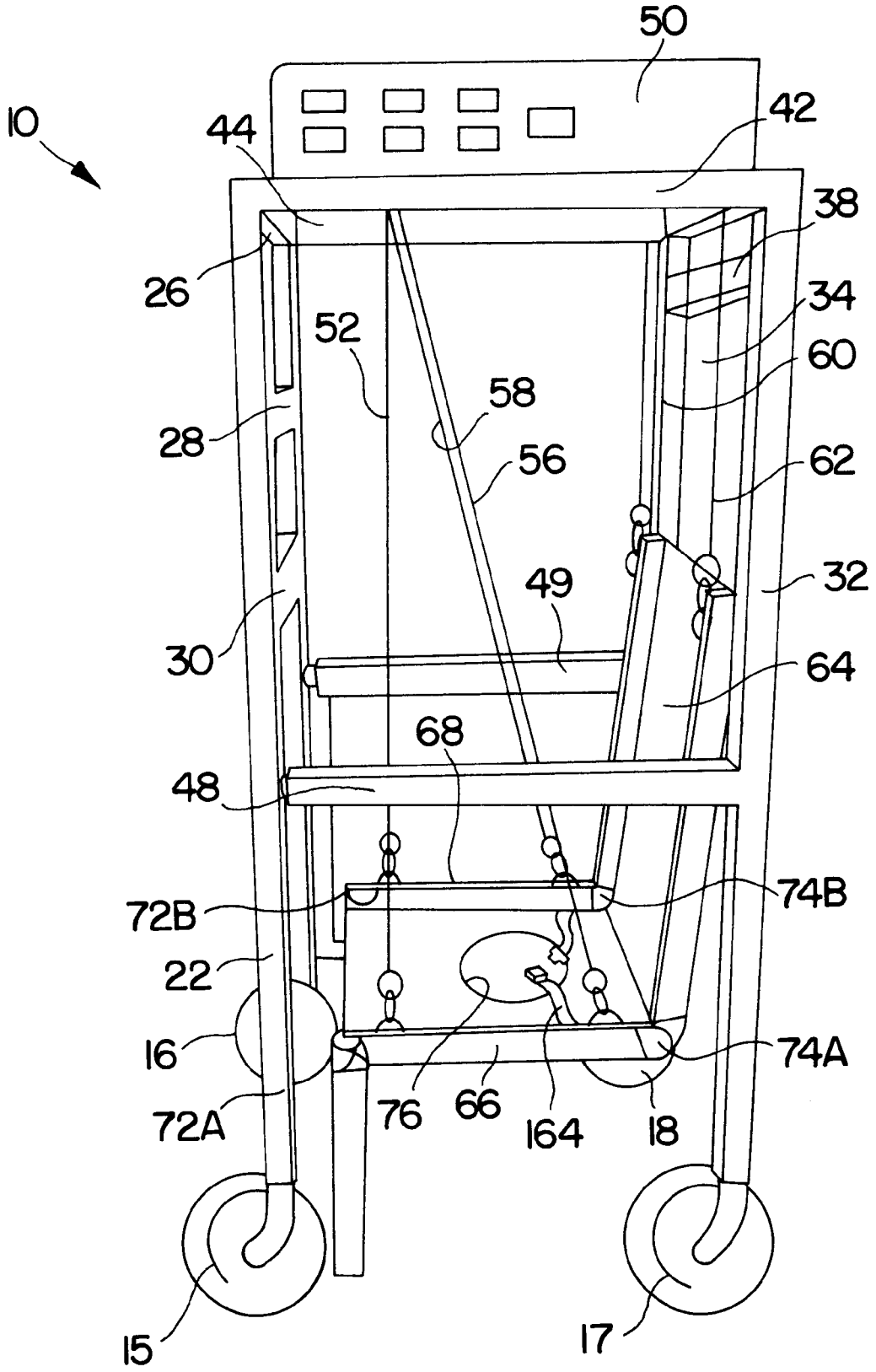
FIG. 11 is a side perspective view of the apparatus in the closed condition with the hammock converted into a seat.

Conversion of the apparatus 10 from a fully expanded open condition, shown in FIG. 9, to a fully retracted closed condition, shown in FIG. 11, is achieved by first actuating linear actuators 30 and 38 to reduce the widthwise dimension of the apparatus 10, as shown in FIG. 10. The slide rods 26A, 28A, 36A, and 46A of the front and rear end frames 12 and 14 and top frame 20 telescope inwardly within their corresponding hollow guide rods 26B, 28B, 36B, and 46B. The head end of the hammock 64 is then raised by the motor assembly 51, as previously described. The foot end of the hammock 64 is raised slightly to disengage front ratchet hinges 72A and 72B and then manually lowered to the desired angle. Finally, the lengthwise dimension of the apparatus 10 is reduced by actuating linear actuators 48 and 49. The slide rods 42A and 44A of the top frame 20 telescope inwardly within their corresponding hollow guide rods 42B and 44B.

Figure 12:
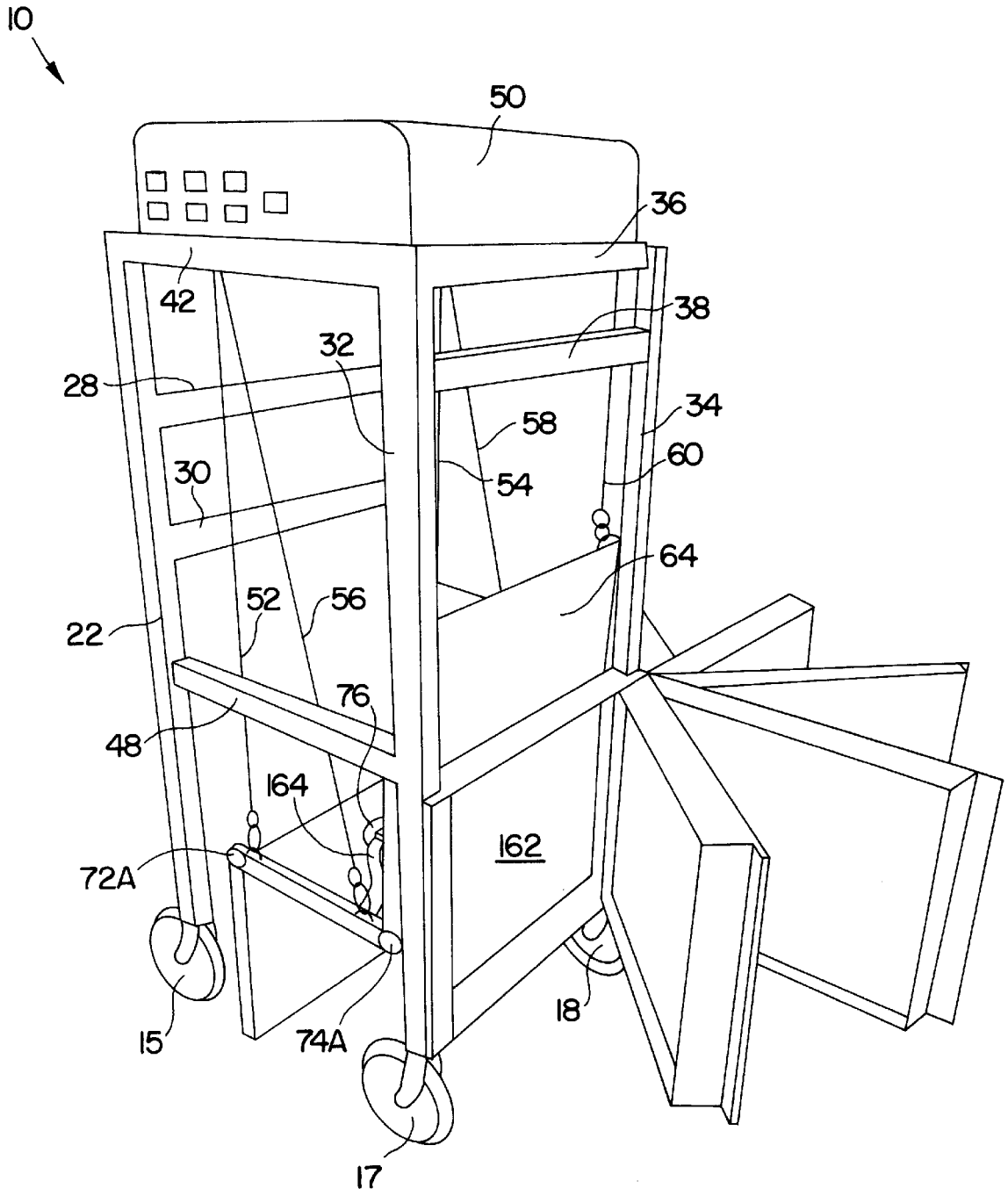
FIG. 12 is a rear perspective view of the apparatus in the closed condition and showing the gate pivoted to a position adjacent the rear end frame.

As best shown in FIG. 12, the apparatus 10 preferably further includes a gate 162 pivotably attached to the vertical support 34 and including a storage compartment for containing all batteries (not shown) necessary for operating the electrical motors 100 and 102 of the motor assembly 51 and linear actuators 30, 38, 48, and 49. For added back support, the gate 162 is pivoted to a position adjacent the rear end frame 14 to reside against the back of the patient when seated.

Operation of the Lifting and Transport Apparatus 10

Figure 13:
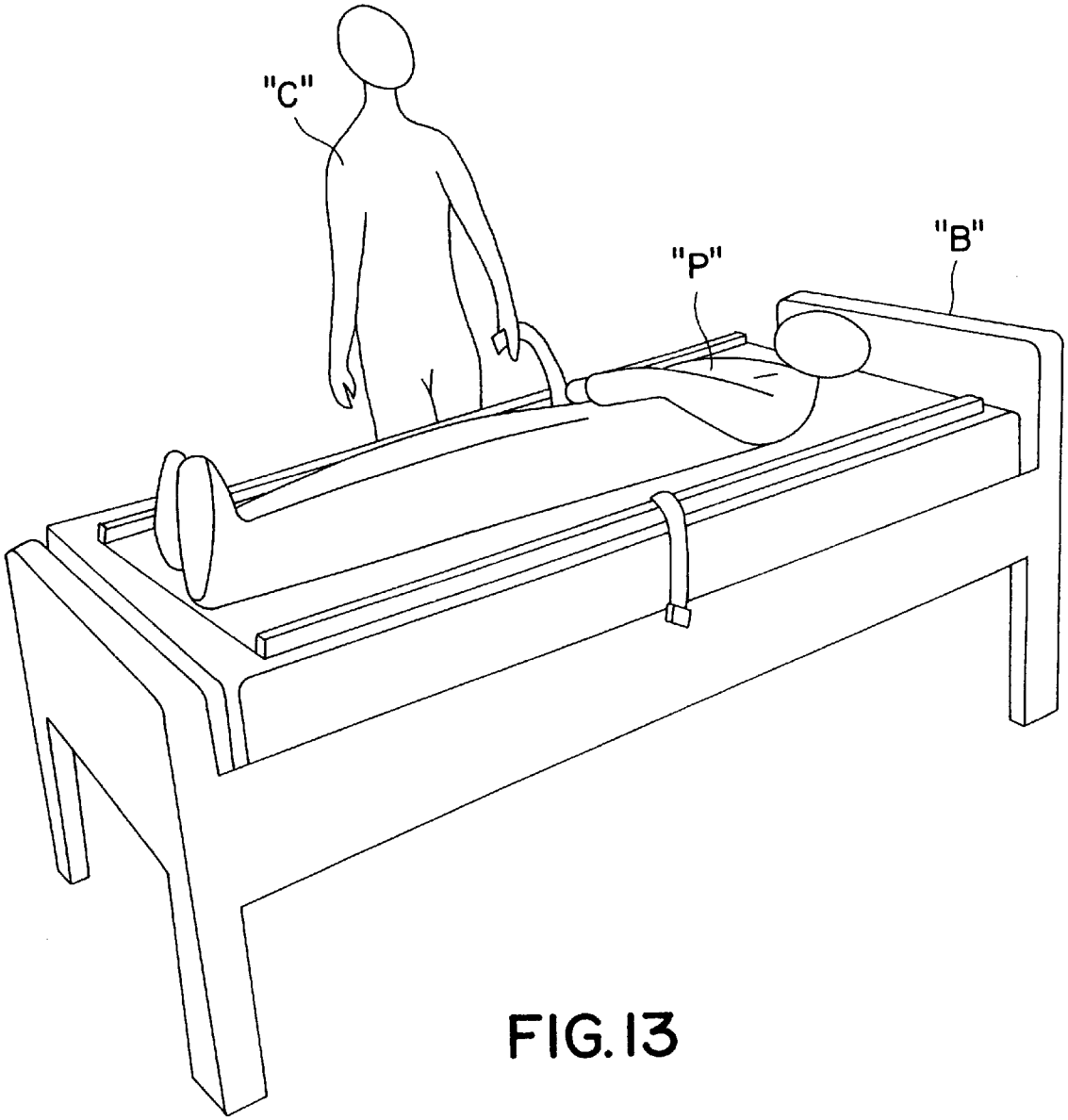
FIGS. 13–27 are views illustrating sequential application of the apparatus for lifting and transporting the patient from the bed to the toilet.
Figure 14:
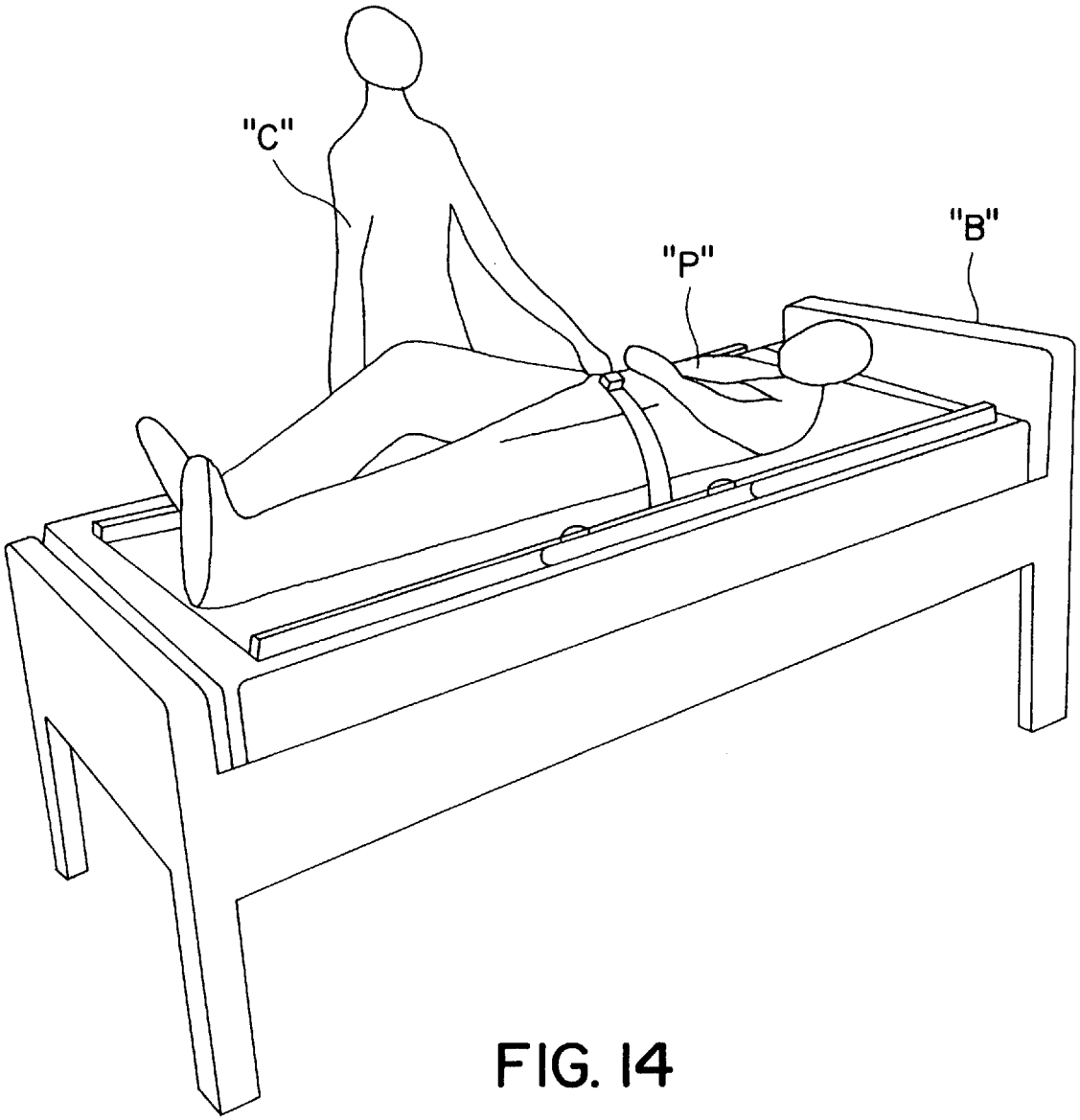
Figure 15:
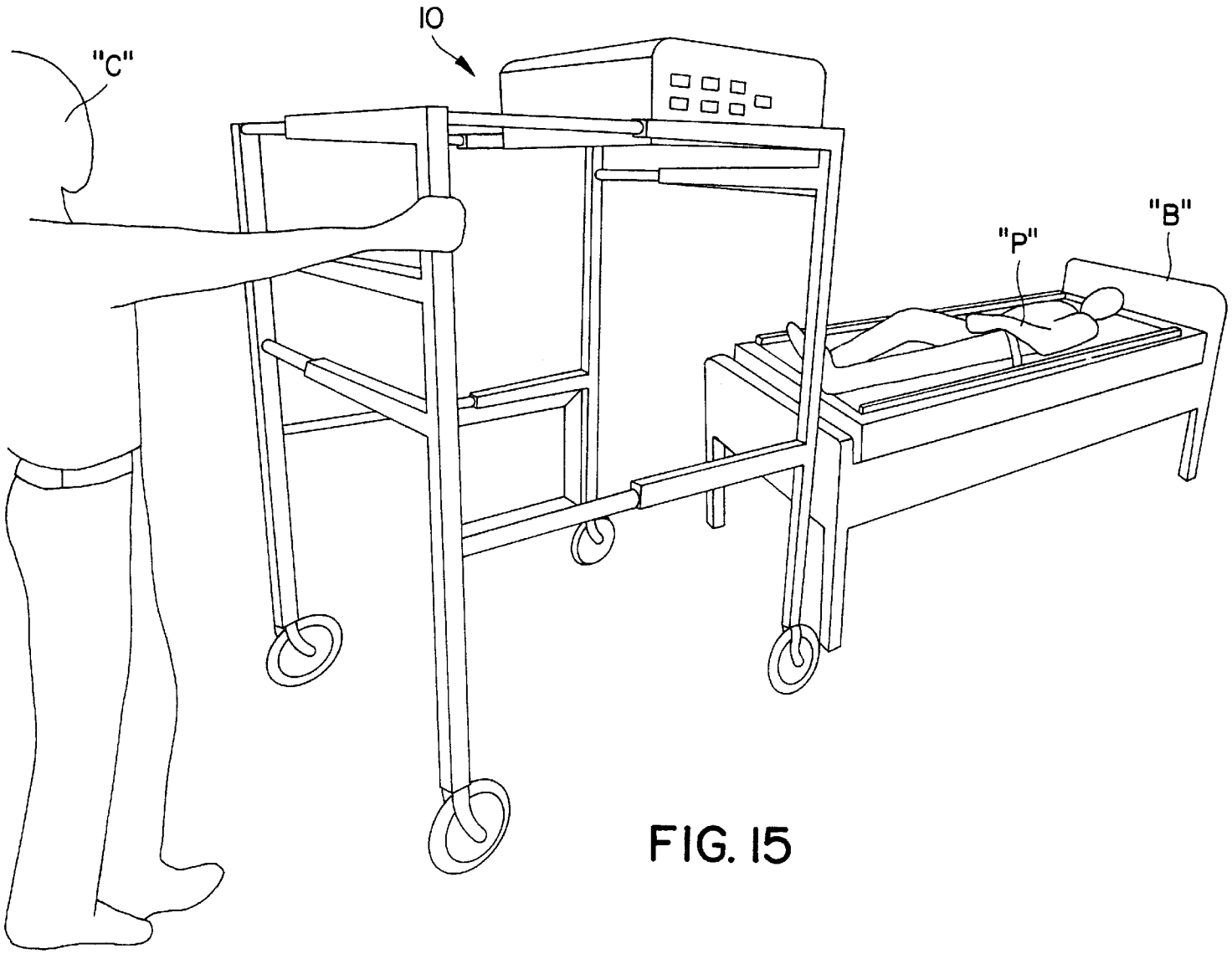
Figure 16:
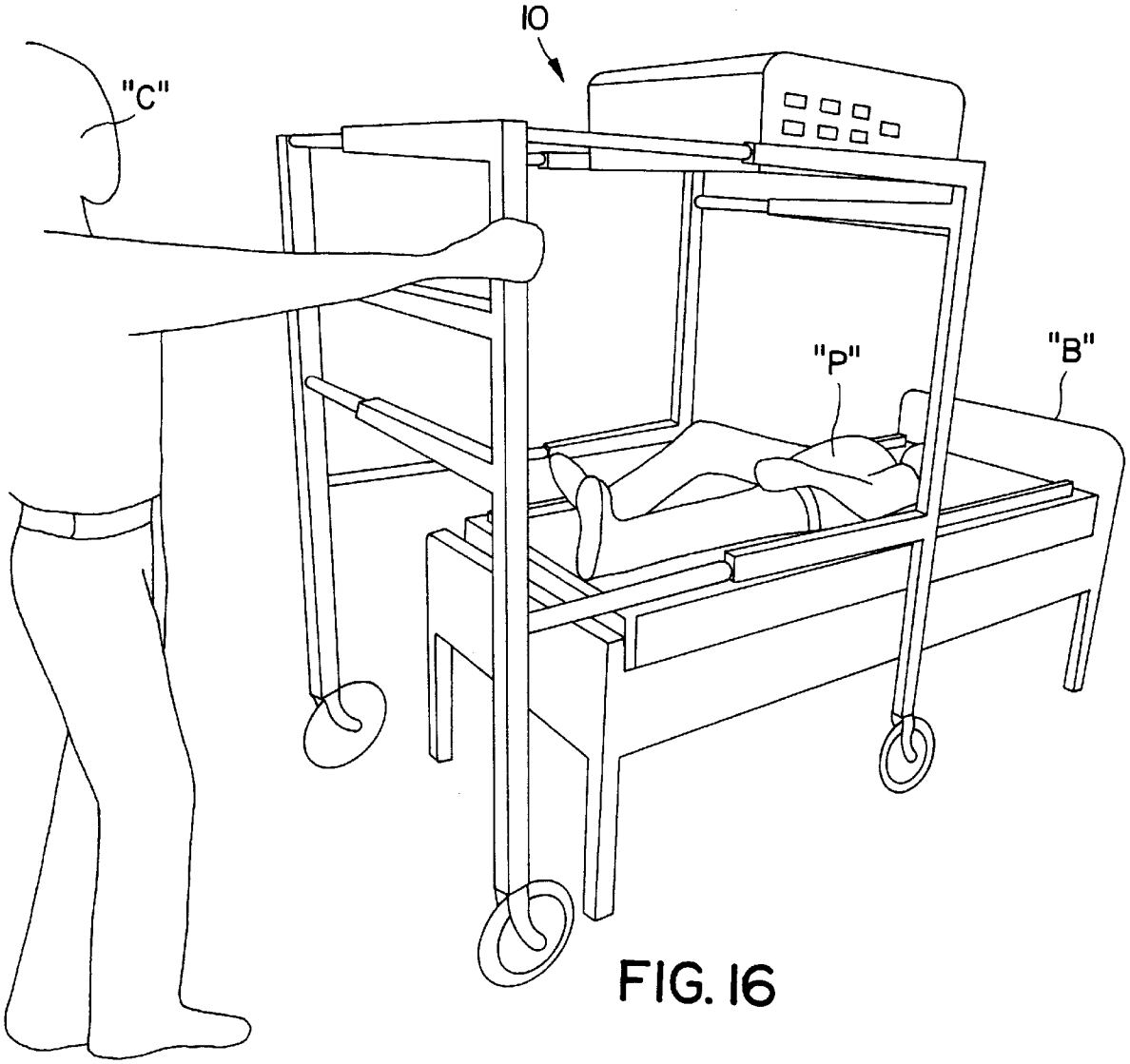
Figure 17:
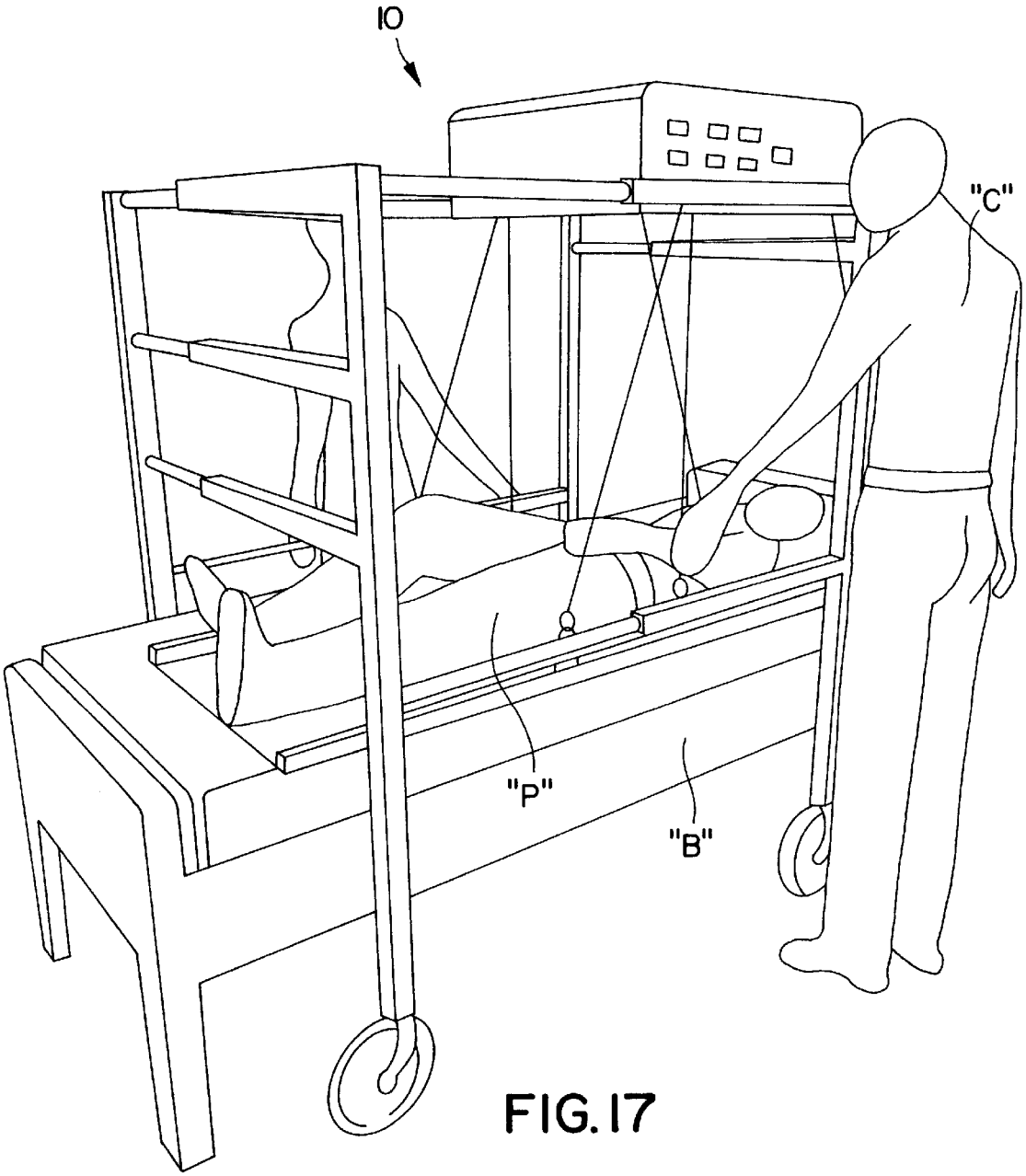
Figure 18:
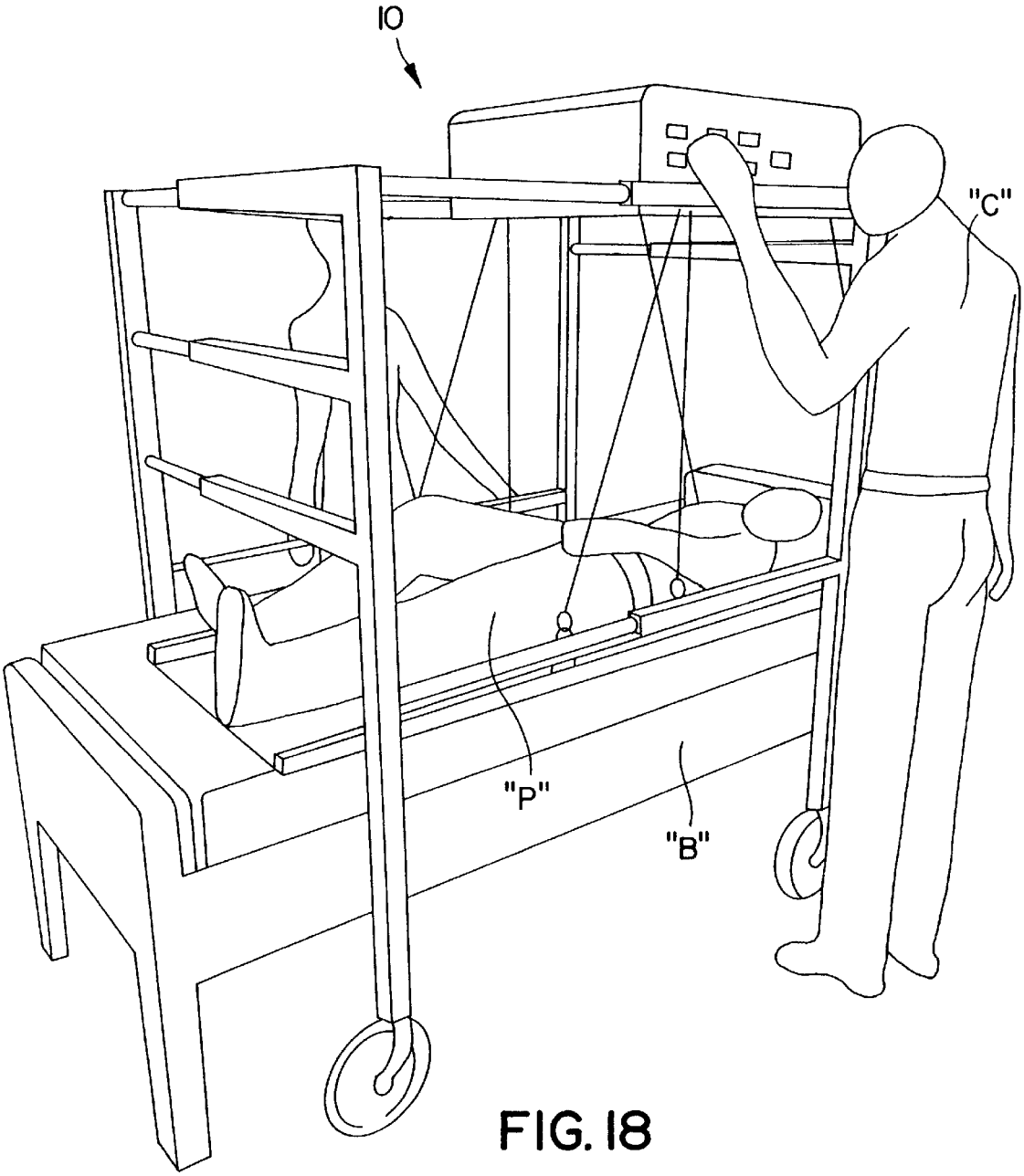
Figure 19:
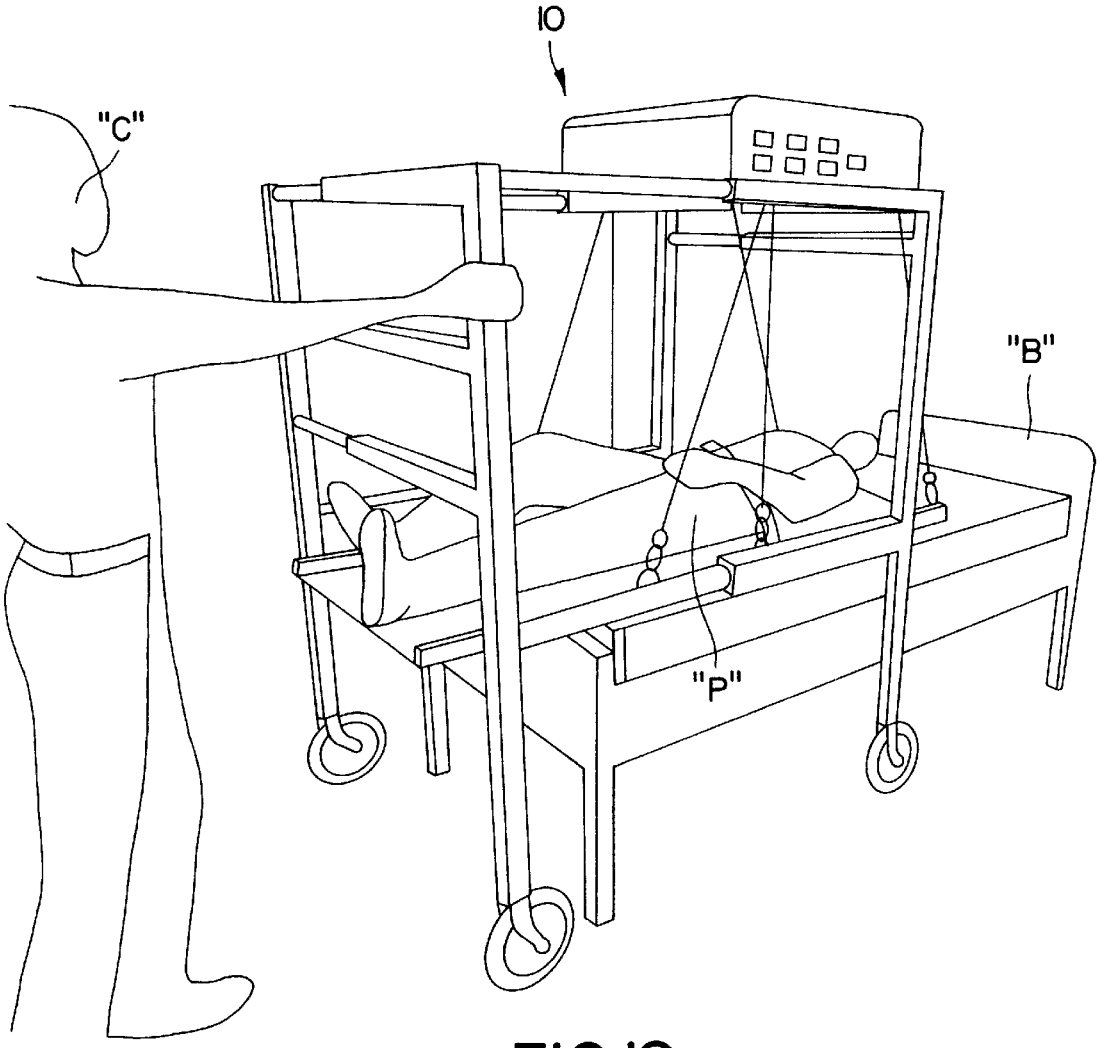
Figure 20:
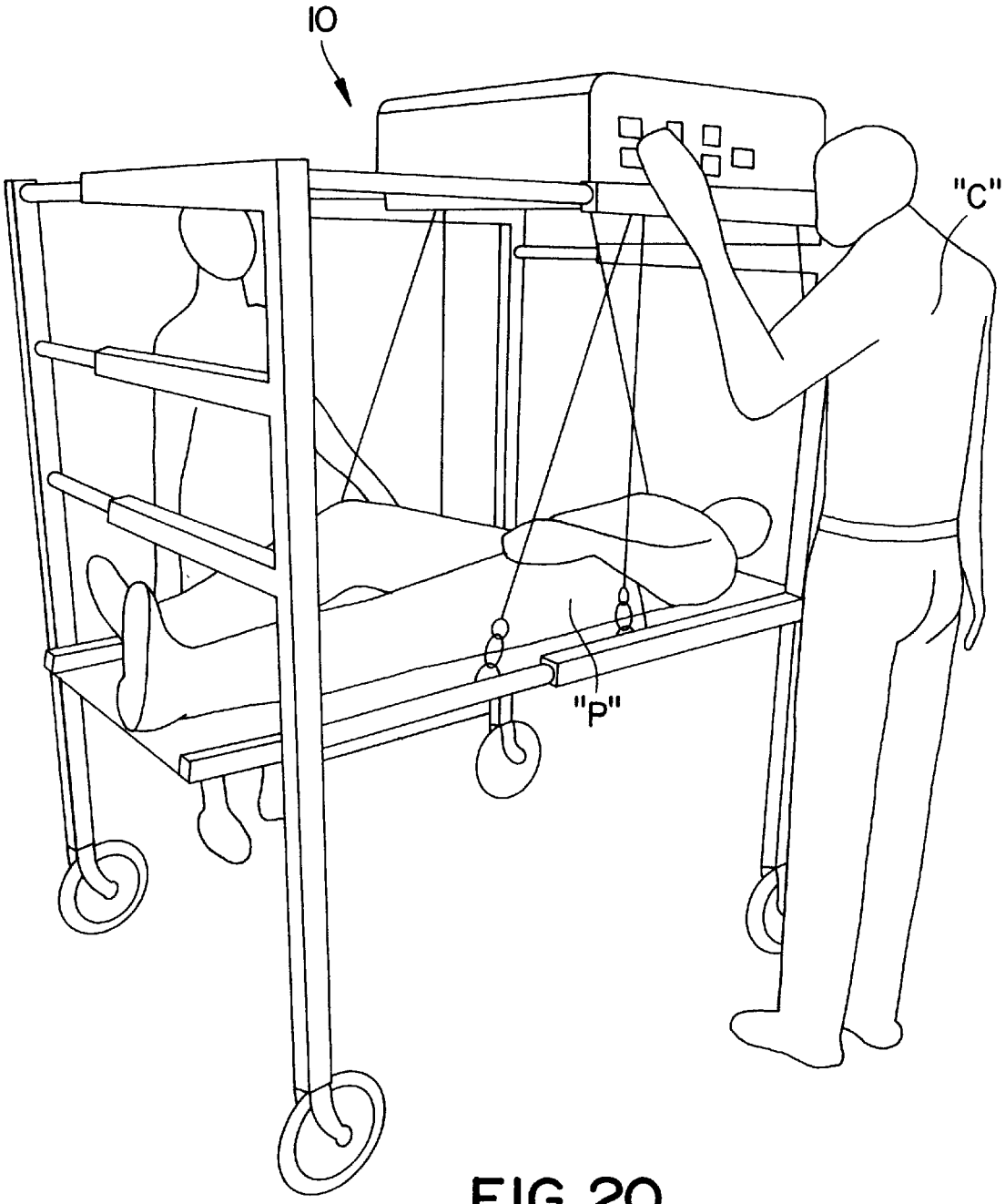
Figure 21:
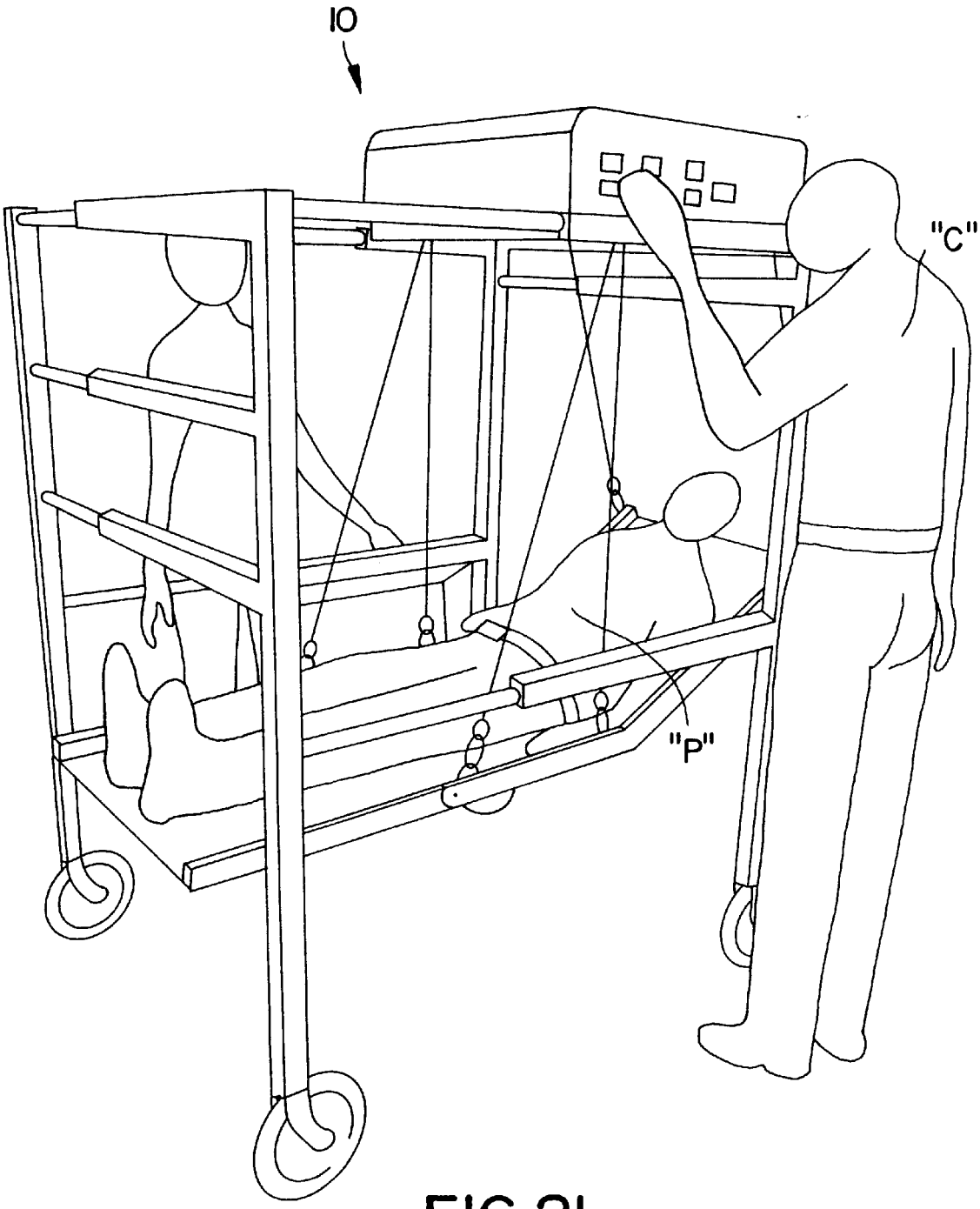
Figure 22:
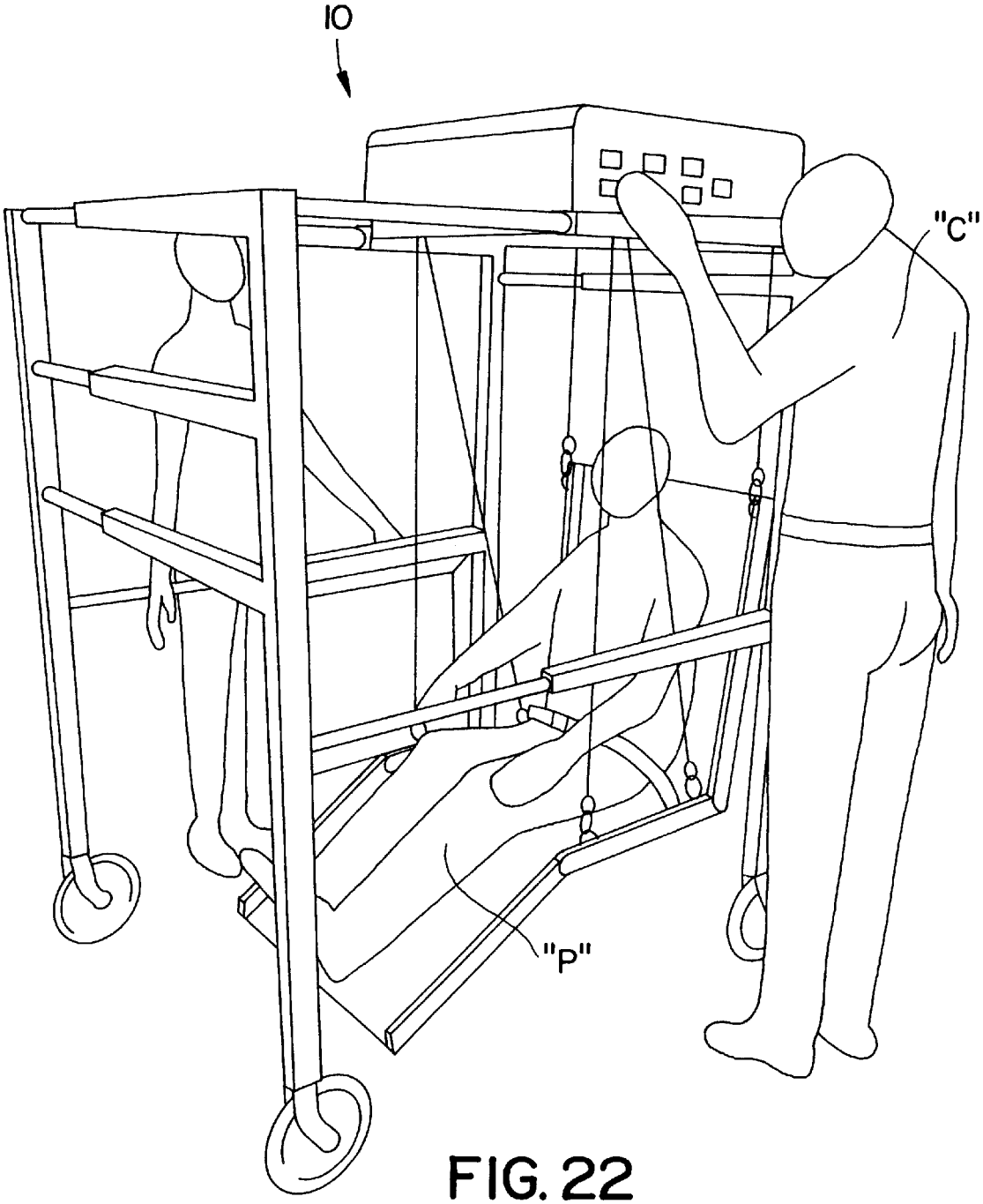
Figure 23:
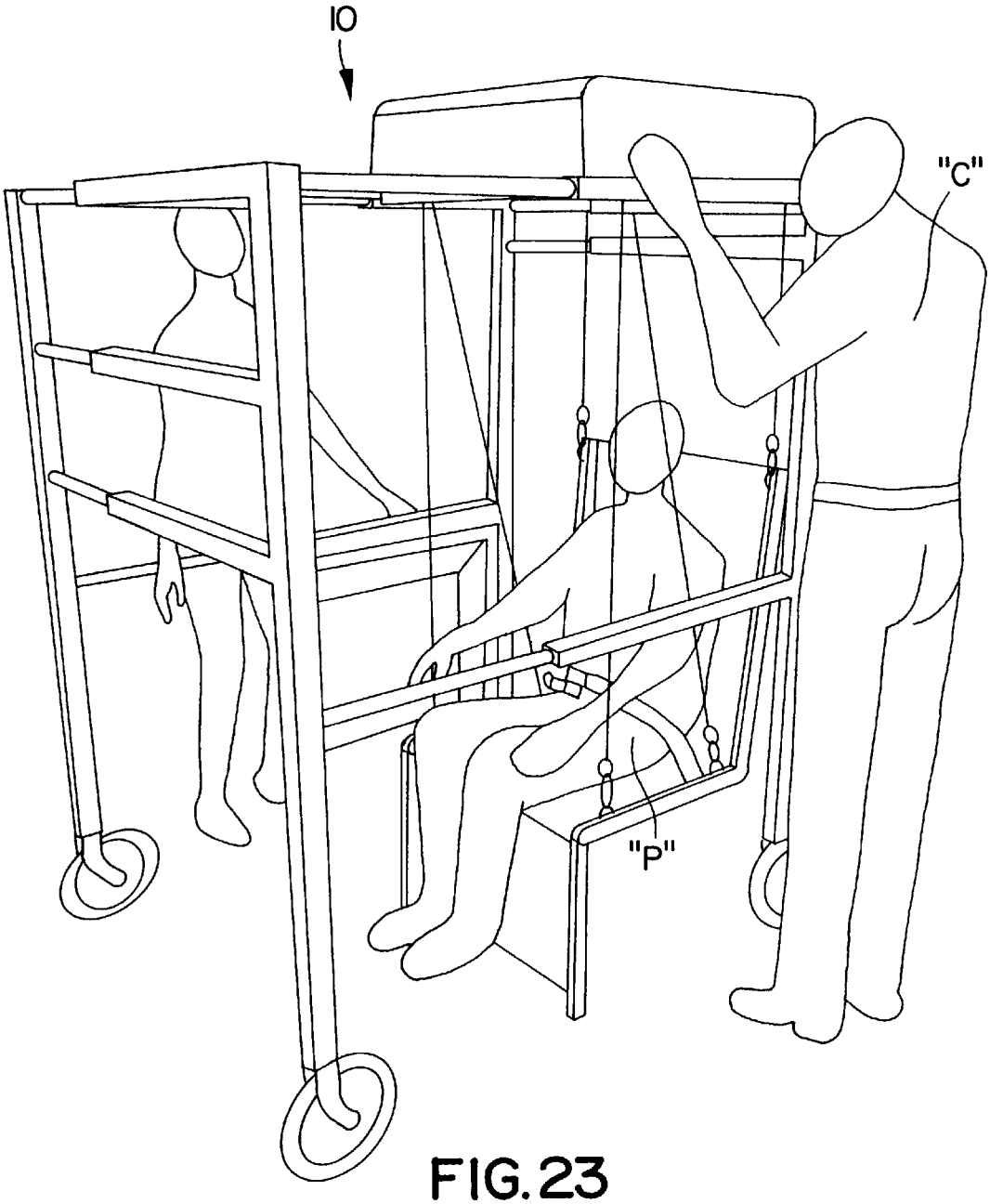
Figure 24:
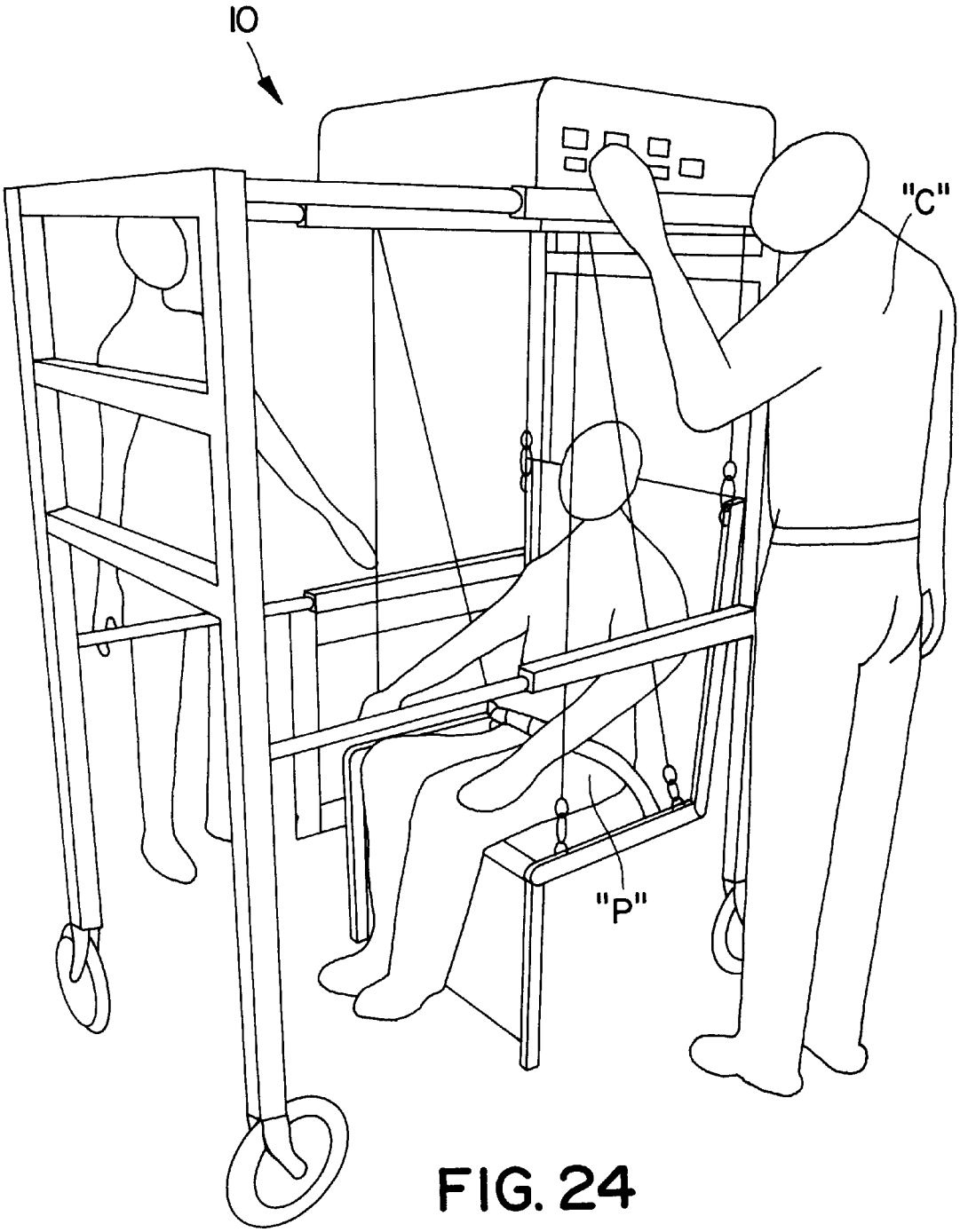

To use the apparatus 10, the patient "P" is first positioned on the hammock 64 by the caregiver "C" and a safety belt 164 fastened around the patient's waist. See FIGS. 13 and 14. The apparatus 10 in the open condition, as shown in FIGS. 15 and 16, is then rolled by the caregiver "C" over the bed "B" with the patient "P" in a supine position. The ends of cables 52, 54, 56, 58, 60, and 62 are attached to the side bars 66 and 68 of the hammock 64, as shown in FIG. 17, or optionally, one or more spreader bars 90 (See FIG. 6). The motor assembly 51 is then activated and the patient "P" lifted and removed from over the bed "B", as shown in FIGS. 18 and 19.

Referring to FIGS. 20–24, the patient "P" is moved from the supine position to a seated position by actuating motor 102 of the motor assembly 51 to lift the head end of the hammock 64. The foot end of the hammock 64 is raised slightly by the caregiver "C" to disengage the ratchet hinges 72A and 72B, and is then manually lowered to the desired angle. Linear actuators 30, 38, 48 and 49 cooperate to close the length and width of the apparatus 10, as previous described.

Figure 25:
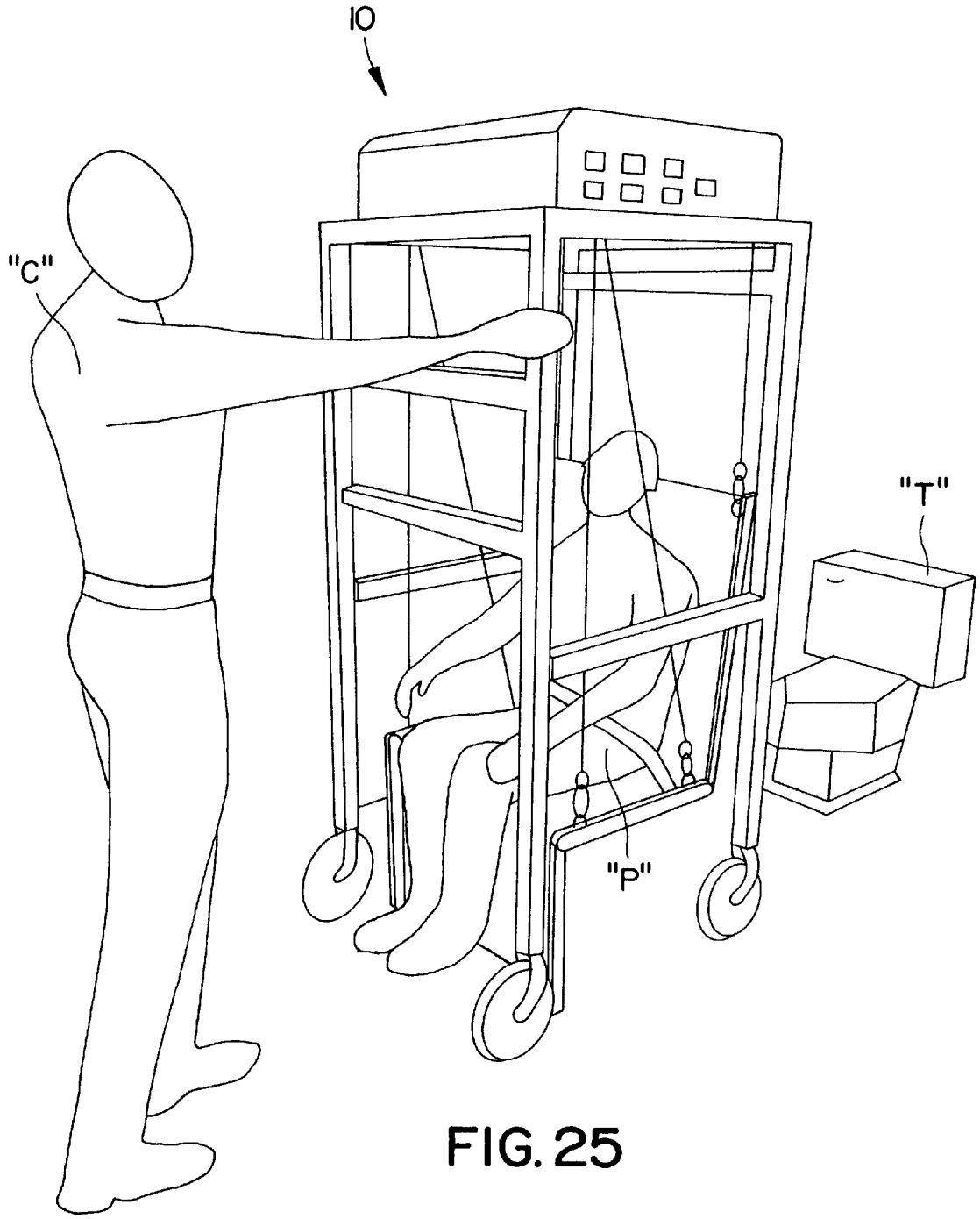
Figure 26:
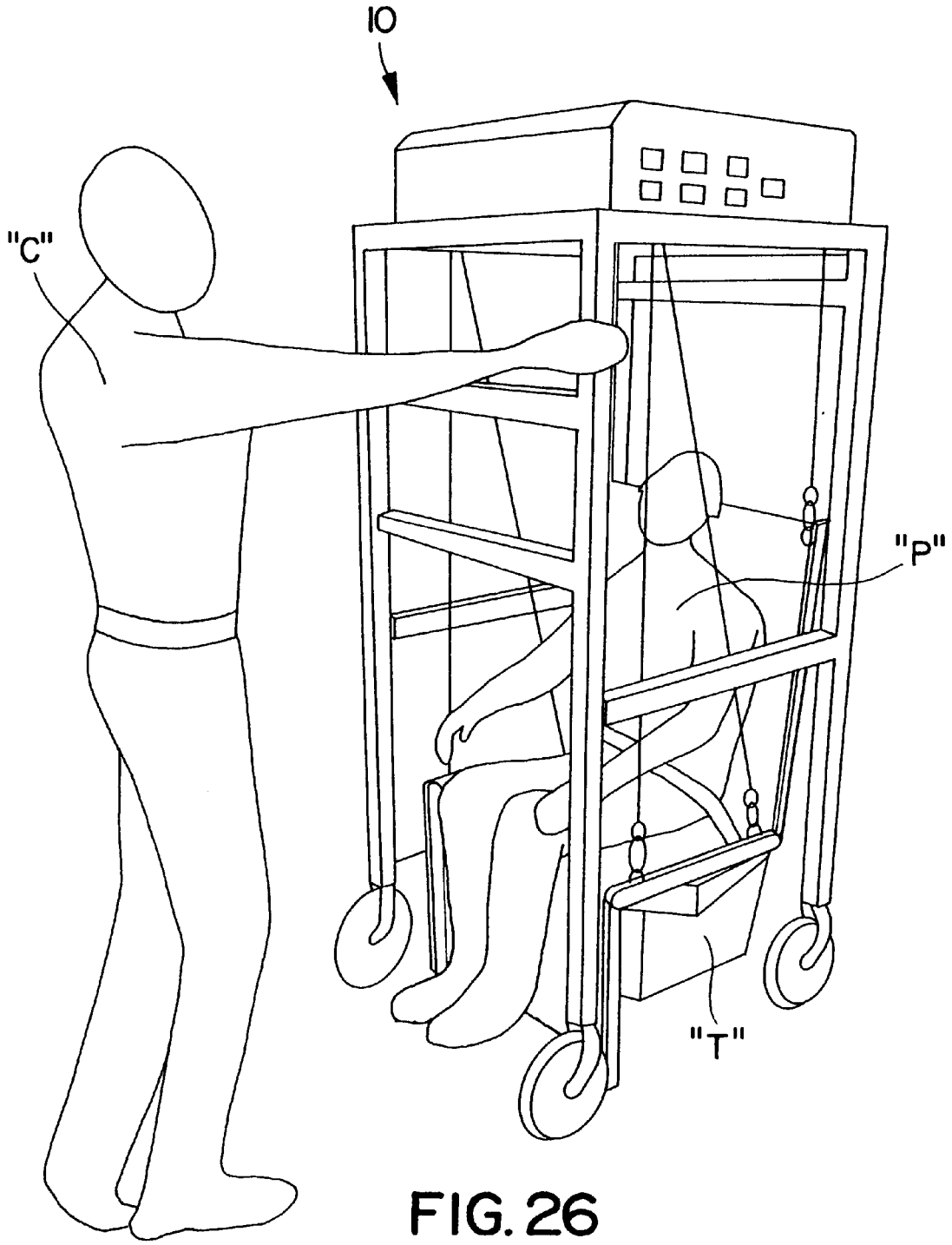
Figure 27:
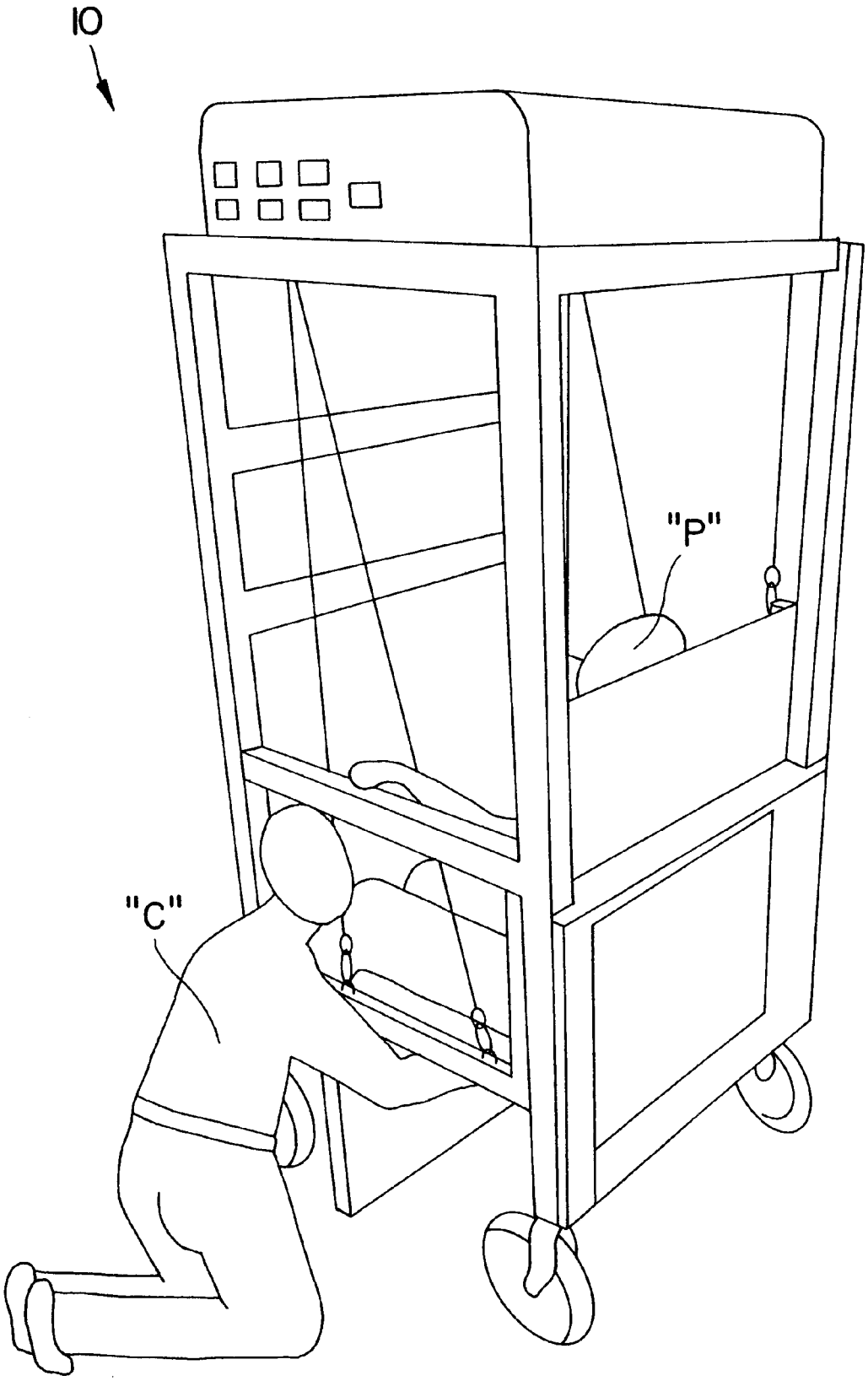

The apparatus 10 is then rolled by the caregiver "C" into the bathroom to a position over the toilet "T", as shown in FIGS. 25 and 26. With the sanitary liner 82 in place beneath the patient, the flap 78 is released from the underside of the hammock 64 and the plastic chute 88 extended downwardly into the toilet "T". This process may be facilitated by activating motor 100 to lift the patient "P" slightly. Once the chute 88 is in place, motor 100 may be further activated to lower the patient "P" closer to the toilet "T". When the patient "P" is finished, the chute 88 is torn away from the paper sheet 84 and disposed of down the toilet "T". The apparatus 10 is moved by the caregiver "C" away from the toilet "T", as shown in FIG. 27, and the patient "P" cleaned and transported back to the room.

Figure 28:
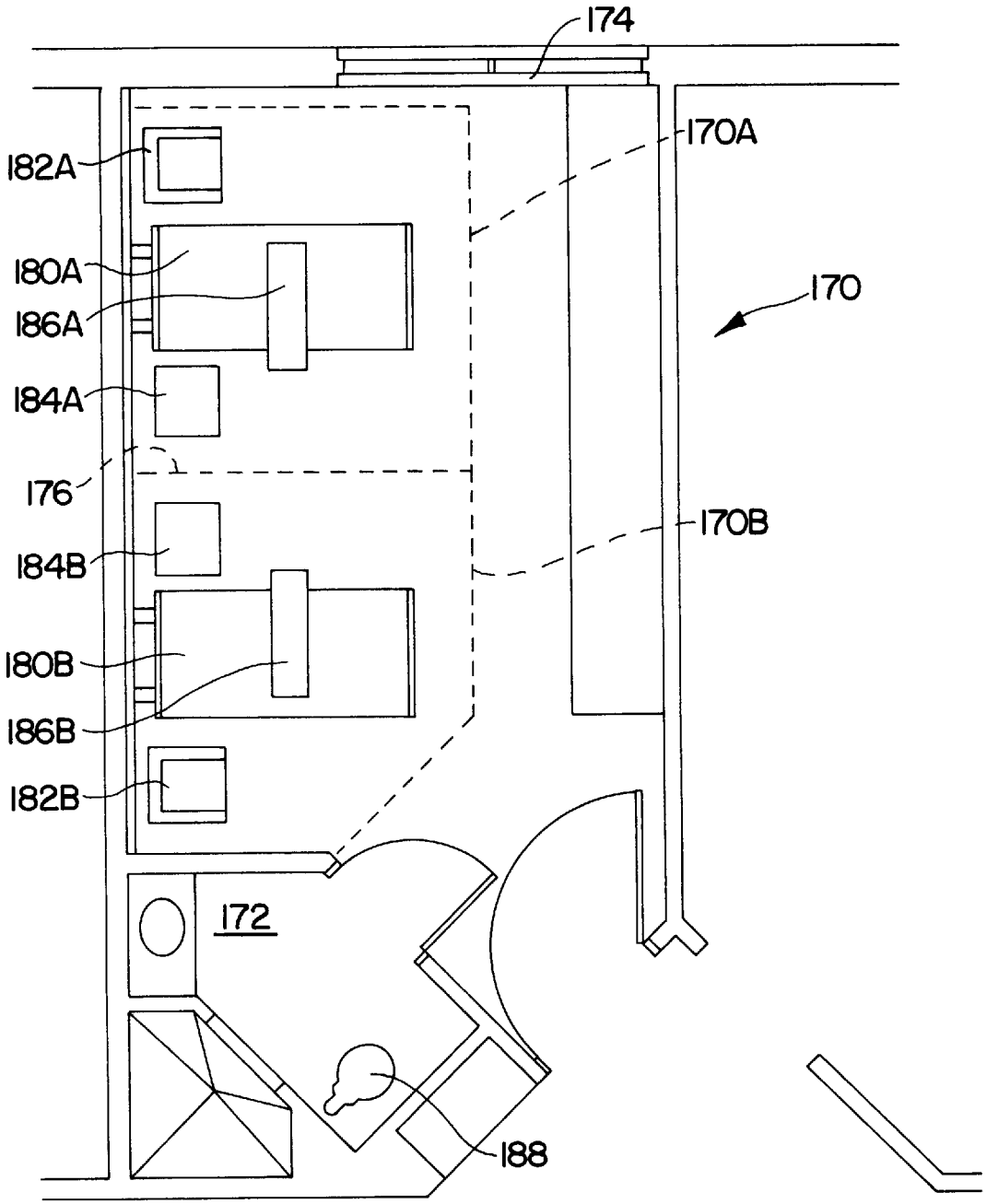
FIG. 28 is a plan view illustrating the layout of a standard semi-private hospital room.
Figure 29:
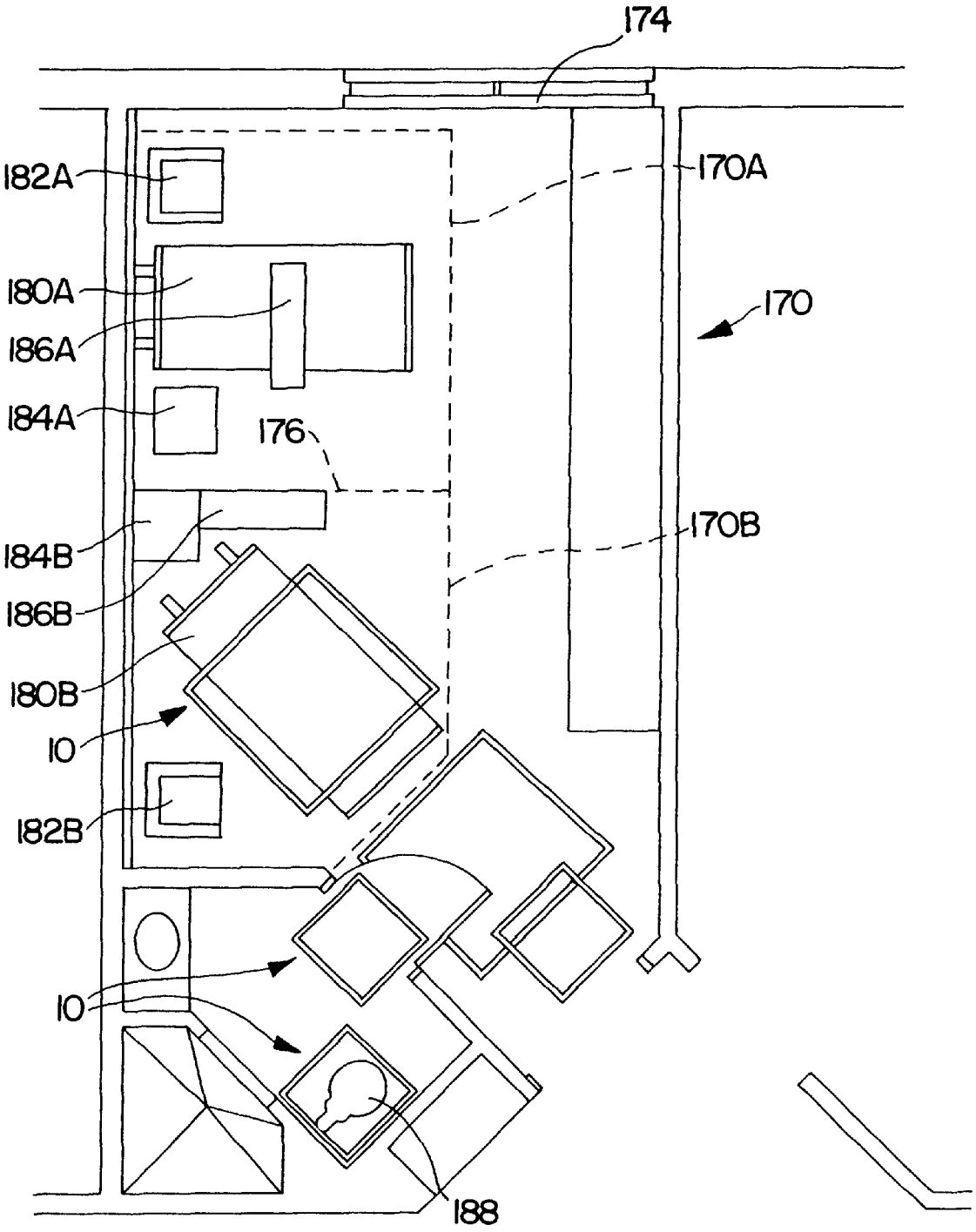
FIG. 29 is a plan view demonstrating transport of a non-window patient from the bed to the bathroom.
Figure 30:
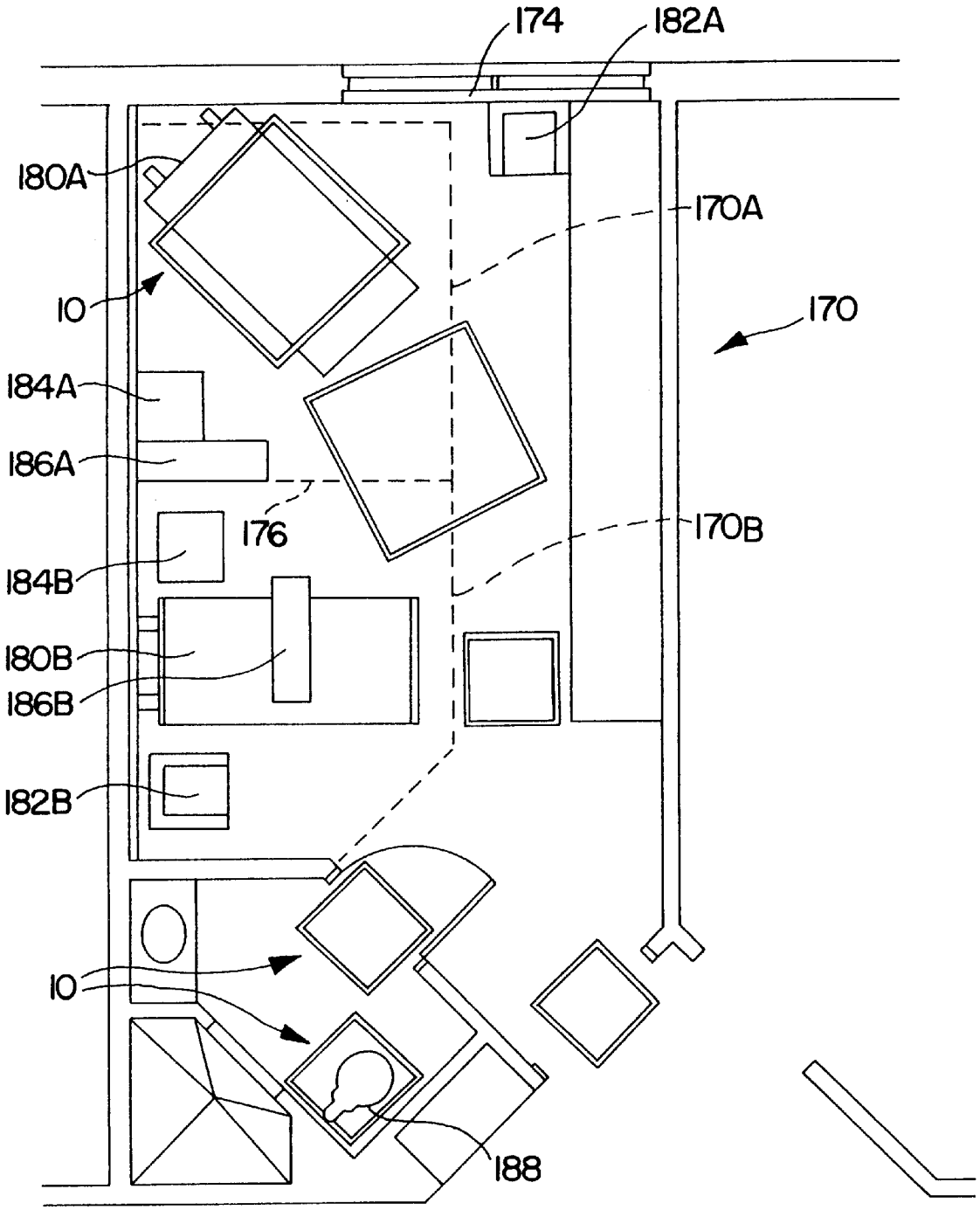
FIG. 30 is a plan view demonstrating transport of a window patient from the bed to the bathroom.

FIGS. 28–30 illustrate maneuvering of the apparatus 10 within a standard semi-private hospital room 170 including a bathroom 172, a window 174, and a partition 176 dividing the room 170 into separate areas 170A and 170B. A typical layout of the room 170 is shown in FIG. 28. Each area 170A and 170B generally includes a bed 180A, 180B, a chair 182A, 182B, bedside table 184A, 184B, and over-bed table 186A, 186B. As shown in FIG. 29, to effect transfer of a non-window patient, the bed 180A is shifted and the bedside table 184A and over-bed table 186A moved against the partition 176. The apparatus 10 is then rolled to the entrance of the bathroom 172 and converted to the closed condition, as previously described. In the closed condition, the apparatus 10 enters the bathroom 172 and is moved over the toilet 188.

Transfer of a window patient is shown in FIG. 30. The bedside table 184B and over-bed table 186B are moved as shown, and the apparatus 10 rolled to the entrance of the bathroom 172 where it converts to the closed condition. In the closed condition, the apparatus 10 enters the bathroom 172 and is moved over the toilet 188.

A patient lifting and transport apparatus is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A convertible patient lifting and transport apparatus, comprising:

(a) a frame assembly mounted on wheels and adapted for rolling movement over a supporting surface, said frame assembly defining a patient carriage zone for being occupied by a patient above the supporting surface;

(b) patient support means carried by said frame assembly for supporting the patient in said carriage zone;

(c) mechanical elevating means for lifting and lowering said patient support means relative to said frame assembly; and (d) frame assembly conversion means comprising first and second linear actuators attached to said frame assembly for moving said frame assembly between an open condition wherein said frame assembly expands for straddling a bed of the patient when lifting and removing the patient from the bed, and a closed condition wherein said frame assembly retracts for transporting the patient to a location away from the bed, the first linear actuator adjusting a widthwise dimension of said apparatus and the second linear actuator adjusting a lengthwise dimension of said apparatus.

2. A patient lifting and transport apparatus according to claim 1, wherein said frame assembly comprises spaced-apart upstanding front and rear end frames, and a top frame arranged above said patient carriage zone and interconnecting said front and rear end frames together.

3. A patient lifting and transport apparatus according to claim 2, wherein said front and rear end frames comprise respective pairs of spaced-apart vertical support members and telescoping lateral cross braces interconnecting the vertical support members of each pair together.

4. A patient lifting and transport apparatus according to claim 3, wherein said top frame comprises first and second spaced-apart, telescoping longitudinal support members connected at their respective opposite ends to the pairs of spaced-apart vertical support members of said front and rear end frames, and telescoping lateral cross braces interconnecting the longitudinal support members together.

5. A patient lifting and transport apparatus according to claim 2, wherein said patient support means comprising a fabric hammock, and a plurality of cables extending downwardly from said top frame for suspending said hammock in said patient carriage zone.

6. A patient lifting and transport apparatus according to claim 5, wherein said hammock includes first and second longitudinal side bars secured to opposite side edges of said hammock.

7. A patient lifting and transport apparatus according to claim 6, wherein each of the side bars includes a back hinge for allowing upward pivoting movement of a back portion of said hammock to lift the patient from a generally supine position to a seated position.

8. A patient lifting and transport apparatus according to claim 7, wherein each of the side bars further includes a front hinge for allowing downward pivoting movement of a front portion of said hammock such that the legs of the patient can bend when in the seated position.

9. A patient lifting and transport apparatus according to claim 8, wherein said front hinge includes ratchet means for adjustably setting the angle of the front portion of said hammock relative to the back portion of said hammock.

10. A patient lifting and transport apparatus according to claim 5, and comprising a safety belt attached to said hammock and adapted for extending around the waist of the patient to secure the patient in said hammock.

11. A patient lifting and transport apparatus according to claim 5, wherein said hammock includes an opening formed in a seat portion thereof for allowing use a toilet by the patient without leaving the apparatus.

12. A patient lifting and transport apparatus according to claim 11, and comprising a disposable sanitary liner placed at the opening of said hammock, and including a cylindrical chute adapted for extending downwardly into the toilet upon use of the toilet by the patient.

13. A patient lifting and transport apparatus according to claim 12, and comprising a flap attached to an underside of said hammock for covering the opening in said hammock before and after use of the toilet by the patient.

14. A patient lifting and transport apparatus according to claim 5, and comprising a lateral spreader bar attached to said hammock and located between said hammock and said cables for maintaining said hammock in a laterally spread condition as the patient is lifted and lowered.

15. A patient lifting and transport apparatus according to claim 5, wherein said mechanical elevating means comprises a motor assembly arranged on said top frame and operatively connected to said plurality of cables for lifting and lowering said cables to adjust said hammock between a generally horizontal condition and an upwardly folded condition.

16. A convertible patient lifting and transport apparatus, comprising:

(a) a frame assembly comprising spaced-apart upstanding front and rear end frames mounted on wheels for rolling movement of said frame assembly over a supporting surface, said front and rear end frames comprising respective pairs of spaced-apart vertical support members and telescoping lateral cross braces interconnecting the vertical support members of each pair together, and said frame assembly further comprising a top frame interconnecting said front and rear end frames together, said top frame comprising first and second spaced-apart, telescoping longitudinal support members connected at their respective opposite ends to said pairs of spaced-apart vertical support members, and telescoping lateral cross braces interconnecting the longitudinal support members together, and said frame assembly defining a patient carriage zone between said front and rear end frames and said top frame for being occupied by a patient above the supporting surface;

(b) patient support means comprising a fabric hammock, and a plurality of cables extending downwardly from said top frame for suspending said hammock in said patient carriage zone;

(c) mechanical elevating means comprising a motor assembly arranged on said top frame and operatively connected to said plurality of cables for lifting and lowering said cables to adjust said hammock between a generally horizontal condition and an upwardly folded condition; and (d) frame assembly conversion means for moving said frame assembly between an open condition wherein said frame assembly expands for straddling a bed of the patient when lifting and removing the patient from the bed, and a closed condition wherein said frame assembly retracts for transporting the patient to a location away from the bed.

17. A patient lifting and transport apparatus according to claim 16, wherein said frame assembly conversion means comprises a linear actuator attached to said frame assembly and adapted for selectively increasing and decreasing a space between the longitudinal support members of the top frame, thereby increasing and decreasing a width of said apparatus.

18. A patient lifting and transport apparatus according to claim 16, wherein said frame assembly conversion means comprises a linear actuator attached to said frame assembly and adapted for selectively increasing and decreasing a space between the front and rear end frames, thereby increasing and decreasing a length of said apparatus.

19. A patient lifting and transport apparatus according to claim 16, wherein said hammock includes first and second longitudinal side bars attached at respective opposite side edges of said hammock.

20. A patient lifting and transport apparatus according to claim 19, wherein each of said supports bars includes a back hinge for allowing upward pivoting movement of a back portion of said hammock to lift the patient from a generally supine position to a seated position.

21. A patient lifting and transport apparatus according to claim 20, wherein each of the side bars further includes a front hinge for allowing downward pivoting movement of a front portion of said hammock such that the legs of the patient can bend when in the seated position.

22. A patient lifting and transport apparatus according to claim 21, wherein said front hinge includes ratchet means for adjustably setting the angle of the front portion of said hammock relative to the back portion of said hammock.

23. A patient lifting and transport apparatus according to claim 16, and comprising a safety belt attached to said hammock and adapted for extending around the waste of the patient to secure the patient in said hammock.

24. A patient lifting and transport apparatus according to claim 16, wherein said hammock includes an opening formed in a seat portion thereof for allowing use a toilet by the patient without leaving the apparatus.

25. A patient lifting and transport apparatus according to claim 24, and comprising a disposable sanitary liner placed at the opening of said hammock, and including a cylindrical chute adapted for extending downwardly into the toilet upon use of the toilet by the patient.

26. A patient lifting and transport apparatus according to claim 25, and comprising a flap attached to an underside of said hammock for covering the opening in said hammock before and after use of the toilet by the patient.

27. A patient lifting and transport apparatus according to claim 16, and comprising a lateral spreader bar attached to opposite side edges of said hammock and located between said hammock and said cables for maintaining said hammock in a laterally spread condition as the patient is lifted and lowered.

28. A method of transporting a patient between a bed and a location away from the bed, comprising the steps of:

(a) providing a transport apparatus comprising a convertible frame assembly mounted on wheels for rolling movement over a supporting surface, said frame assembly being movable between an open condition and a closed condition;

(b) moving the frame assembly in the open condition to a position straddling the bed of the patient;

(c) positioning the patient on support means carried by said frame assembly for supporting the patient in a carriage zone defined by said frame assembly;

(d) moving said frame assembly away from its position straddling the bed with the patient located in said carriage zone, and converting said frame assembly from the open condition to the closed condition to reduce its widthwise and lengthwise dimension; and (e) transporting the patient to the location away from the bed and upon return of the patient to the bed, converting said frame assembly back to the open condition to increase its widthwise and lengthwise dimension, such that said frame assembly is moveable back to the position straddling the bed to unload the patient onto the bed.

29. A method according to claim 28, and comprising the step of adjusting said support means to move the patient from a generally supine position to a seated position.

30. A convertible patient lifting and transport apparatus, comprising:

(a) a frame assembly mounted on wheels and adapted for rolling movement over a supporting surface, said frame assembly defining a patient carriage zone for being occupied by a patient above the supporting surface;

(b) patient support means carried by said frame assembly for supporting the patient in said carriage zone; and (c) patient support conversion means for moving said patient support means between a generally horizontal condition wherein the patient lies supine in said carriage zone, and an upwardly folded condition wherein said patient sits generally upright in said carriage zone and (d) frame assembly conversion means comprising first and second linear actuators attached to said frame assembly for moving said frame assembly between an open condition wherein said frame assembly expands for straddling a bed of the patient when lifting and removing the patient from the bed, and a closed condition wherein said frame assembly retracts for transporting the patient to a location away from the bed, the first linear actuator adjusting a widthwise dimension of said apparatus and the second linear actuator adjusting a lengthwise dimension of said apparatus.

31. A patient lifting and transport apparatus according to claim 30, wherein said patient support means comprising a fabric hammock, and a plurality of cables extending downwardly from said top frame for suspending said hammock in said patient carriage zone.

32. A patient lifting and transport apparatus according to claim 31, wherein said hammock includes first and second longitudinal side bars secured to opposite side edges of said hammock.

33. A patient lifting and transport apparatus according to claim 32, wherein each of the side bars includes a back hinge for allowing upward pivoting movement of a back portion of said hammock to lift the patient from a generally supine position to a seated position.

34. A patient lifting and transport apparatus according to claim 33, wherein each of the side bars further includes a front hinge for allowing downward pivoting movement of a front portion of said hammock such that the legs of the patient can bend when in the seated position.

35. A patient lifting and transport apparatus according to claim 34, wherein said front hinge includes ratchet means for adjustably setting the angle of the front portion of said hammock relative to the back portion of said hammock.

36. A patient lifting and transport apparatus according to claim 31, wherein said patient support conversion means comprises a motor assembly arranged on said top frame and operatively connected to said plurality of cables for selectively lifting and lowering said cables to convert said hammock between the horizontal condition wherein the patient lies supine in said carriage zone, and the upwardly folded condition wherein said patient sits generally upright in said carriage zone.

* * * * *